US011345176B2

(12) United States Patent
Kuriyama et al.

(10) Patent No.: US 11,345,176 B2
(45) Date of Patent: May 31, 2022

(54) RECORDING APPARATUS, CONTROL METHOD, AND STORAGE MEDIUM

(71) Applicant: CANON KABUSHIKI KAISHA, Tokyo (JP)

(72) Inventors: Keiji Kuriyama, Saitama (JP); Yoshinori Nakajima, Kanagawa (JP); Akihiro Tomida, Kanagawa (JP); Hidehiko Kanda, Kanagawa (JP); Takeshi Yazawa, Kanagawa (JP); Naomi Yamamoto, Kanagawa (JP); Takayuki Ushiyama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/122,951

(22) Filed: Dec. 15, 2020

(65) Prior Publication Data

US 2021/0187986 A1 Jun. 24, 2021

(30) Foreign Application Priority Data

Dec. 19, 2019 (JP) ..... JP2019-229267

(51) Int. Cl.

| | |
|---|---|
| ***B41J 29/393*** | (2006.01) |
| ***B41J 2/21*** | (2006.01) |
| ***B41J 2/045*** | (2006.01) |
| ***B41J 19/14*** | (2006.01) |

(52) U.S. Cl.

CPC ..... *B41J 29/393* (2013.01); *B41J 2/04573* (2013.01); *B41J 2/2132* (2013.01); *B41J 19/145* (2013.01); *B41J 2029/3935* (2013.01)

(58) Field of Classification Search

CPC . B41J 2/51; B41J 2/2132; B41J 29/393; B41J 2029/3935; H04N 1/6033; H04N 1/6041; H04N 1/6044

See application file for complete search history.

(56) References Cited

U.S. PATENT DOCUMENTS

2002/0051002 A1* 5/2002 Kumada ..... H04N 1/6033 345/600

FOREIGN PATENT DOCUMENTS

JP 2009143152 A 7/2009

* cited by examiner

*Primary Examiner* — Julian D Huffman

(74) *Attorney, Agent, or Firm* — Canon U.S.A., Inc. IP Division

(57) ABSTRACT

There is a case where a reading unit cannot read an entire area of a recording medium in a scanning direction of a carriage, or a case where reading accuracy is low in the entire area. In such a case, a result of reading a test pattern for adjusting an ejection timing at each position cannot be obtained with high accuracy in a single reading operation. In order to solve the issue, a recording apparatus performs a reading operation a plurality of times and generates, based on results from the respective operations, an adjustment value for adjusting the ejection timing at each position in the scanning direction.

17 Claims, 23 Drawing Sheets

RECORDING APPARATUS, CONTROL METHOD, AND STORAGE MEDIUM

BACKGROUND

Field of the Disclosure

The present disclosure relates to a recording apparatus for recording an image on a recording medium, a control method thereof, and a storage medium.

Description of the Related Art

There is known a recording apparatus that records an image on a recording medium such as paper using a recording unit having a plurality of ejection ports. The recording apparatus ejects ink droplets from each of the ejection ports of the recording unit to form ink dots on the recording medium while relatively moving a carriage with the recording unit mounted thereon and the recording medium. In such a recording apparatus, registration adjustment is performed as processing for determining an appropriate ejection timing so that the landing positions of ink droplets ejected from the respective ejection port arrays match each other.

An example of a registration adjustment method for a recording unit having a plurality of ejection port arrays will be described. First, a reference pattern is recorded using an ejection port array serving as a reference, and a plurality of test patterns of which recording positions are slightly shifted from the recording position of the reference pattern is recorded using another ejection port array. Then, the recorded patterns are measured with an optical sensor, and a correction value (hereinafter referred to as a registration adjustment value) for correcting an ejection timing is calculated based on a result of the measurement so that the recording positions of ink droplets from the respective ejection port arrays match each other.

Japanese Patent Application Laid-Open No. 2009-143152 discusses a method for obtaining the registration adjustment value corresponding to a position of a carriage in an entire main scanning area, based on a dot recording position deviation amount corresponding to the position of the carriage.

SUMMARY

According to an aspect of the present disclosure, a recording apparatus includes a carriage configured to mount a recording unit and a reading unit thereon and to scan in a scanning direction intersecting with a predetermined direction, the recording unit including an ejection port array in which a plurality of ejection ports for ejection of ink is arranged in the predetermined direction, a conveyance member configured to convey a recording medium in a conveyance direction intersecting with the scanning direction, a control unit configured to control, using the recording unit, a recording operation for recording a test pattern including patches on an entire area of the recording medium in the scanning direction in order to control the ejection of ink at each position in the scanning direction, and to control, using the reading unit, a reading operation for reading the test pattern recorded on the recording medium while causing the carriage to scan, and a generation unit configured to generate an adjustment value for controlling the ejection of ink at each position in the scanning direction, based on a result of the reading in the reading operation. The control unit executes a first reading operation for reading the test pattern and a second reading operation for reading the test pattern in a state where a leading edge and a trailing edge of the recording medium on which the test pattern is recorded are reversed with respect to the conveyance direction in which the recording medium is conveyed during the reading in the first reading operation. The generation unit generates the adjustment value for controlling the ejection of ink at each position in the scanning direction, based on a first reading result from the first reading operation and a second reading result from the second reading operation.

Further features of the present disclosure will become apparent from the following description of exemplary embodiments with reference to the attached drawings.

DESCRIPTION OF THE EMBODIMENTS

In recent years, it has been required to reduce the size of the main body of a recording apparatus, particularly the width of the main body in the scanning direction of a recording unit, namely the lateral width of the recording apparatus. In order to achieve the size reduction, it is necessary to bring the width of the main body close to the maximum width among widths of recording medium sizes supported by the recording apparatus.

However, in a case where the main body is designed to be downsized with respect to the scanning direction of the recording unit, a reading unit mounted on a carriage may not be able to read the entire area of a conveyed recording medium. The recording unit and the reading unit mounted on the carriage are separated from each other by a predetermined distance in the scanning direction. Thus, if the main body is downsized with a high priority on an image recording operation, more specifically, the main body is downsized so that the scanning area of the recording unit corresponds to the entire area of the maximum-width recording medium, the reading unit, which is positioned separately from the recording unit, may not be able to read the entire area of the maximum-width recording medium. Accordingly, there is an issue where, even if the test pattern for registration adjustment described above is recorded on the entire area of the maximum-width recording medium, the reading unit may not be able to read part of the area, and thus a correction value may not be able to be calculated for each position in the entire area, based on a result of a single reading operation. In addition, even if the reading unit can read the entire area of the maximum-width recording medium, there may be a case where a highly accurate measurement result cannot be obtained from a part of the area.

In view of the above-described issues, exemplary embodiments described below are directed to performing highly accurate registration adjustment in the entire area of the maximum-width recording medium even in a case where the reading unit cannot read the entire area of the conveyed recording medium at a time or in a case where measurement result accuracy is low in a part of the area.

Next, a first exemplary embodiment of the present disclosure will be described with reference to the attached drawings.

Figure 1:
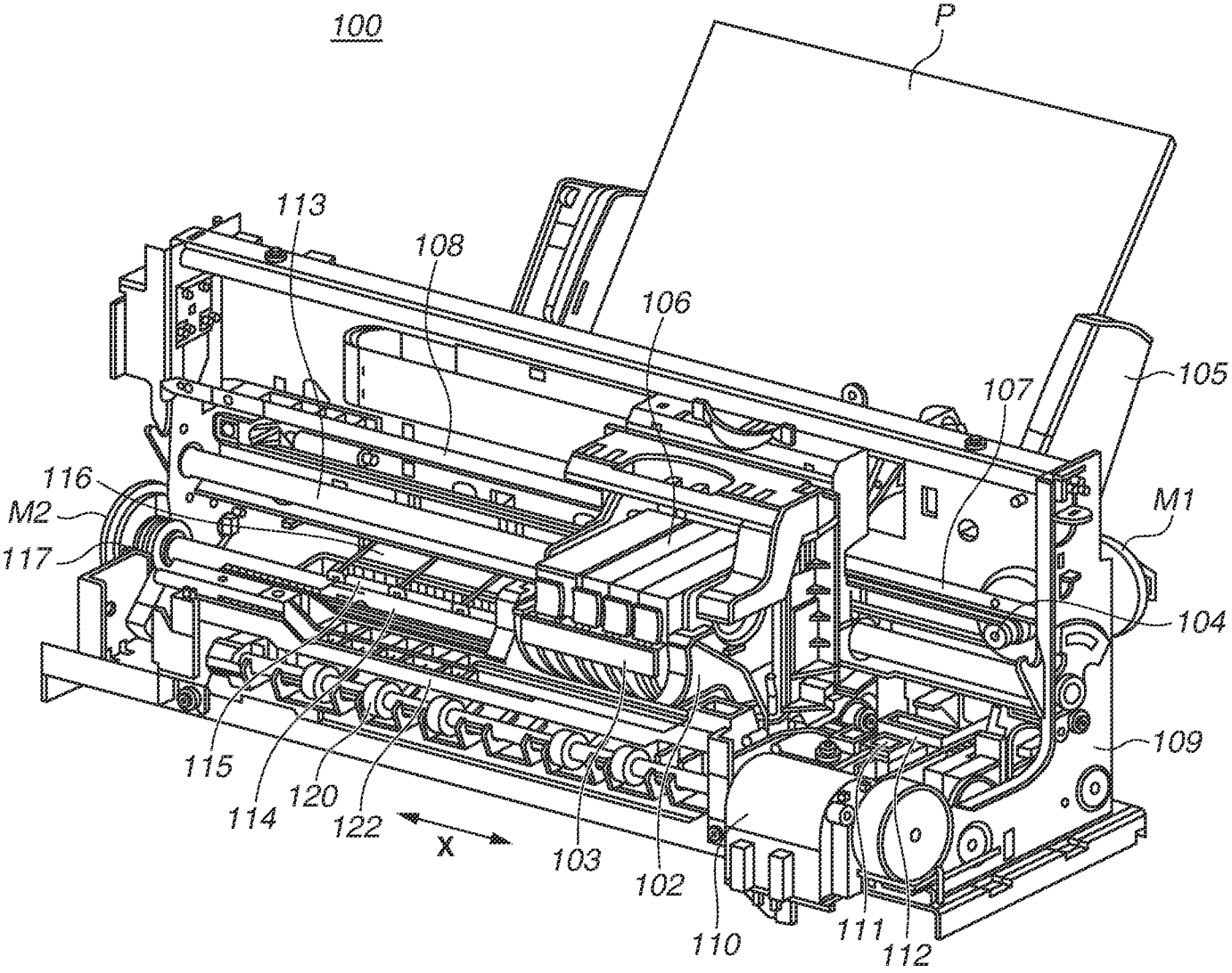
FIG. 1 is an external perspective view illustrating an outline of an inkjet recording apparatus.

FIG. 1 is an external perspective view illustrating an outline of an inkjet recording apparatus according to the present exemplary embodiment. A recording apparatus 100 is an inkjet recording apparatus including a recording head 103 that ejects ink droplets to record an image using an inkjet method. A carriage 102 is provided with the recording head 103, and is caused to reciprocate and scan in an X direction indicated by an arrow by a driving force generated by a carriage motor M1. The driving force is transmitted to the carriage 102 via a transmission mechanism 104. A recording medium P such as recording paper is fed via a sheet feeding mechanism 105 and is conveyed to a position facing the recording head 103. The carriage 102 reciprocates and scans in the X direction that intersects with a conveyance direction of the recording medium P, during which ink droplets are ejected from the recording head 103 to record an image on the recording medium P.

Ejection recovery processing for ejecting ink properly from the recording head 103 is performed before and after an image recording operation or between recording scans. The ejection recovery processing is performed in a state where the carriage 102 has been moved to the position of a recovery device 110.

The carriage 102 mounts thereon the recording head 103 and an ink cartridge 106 that stores the ink to be supplied to the recording head 103. The recording apparatus 100 according to the present exemplary embodiment can record a color image, and the carriage 102 can mount the four ink cartridges 106 respectively storing magenta (M), cyan (C), yellow (Y), and black (K) inks. Each of the four ink cartridges 106 can be independently attached to and detached from the carriage 102.

The joint surfaces of the carriage 102 and the recording head 103 are properly brought into contact with each other, so that the carriage 102 and the recording head 103 can achieve and maintain required electrical connection. When energy is applied to the recording head 103 based on a recording signal, the recording head 103 selectively ejects ink droplets from a plurality of ejection ports. The recording head 103 according to the present exemplary embodiment is an inkjet type recording head that ejects ink droplets using thermal energy, and each of the ejection ports is provided with an electrothermal conversion element as a recording element. Ink droplets are ejected from the ejection port by application of a pulse voltage to the corresponding electrothermal conversion element based on a recording signal. A configuration of the recording head 103 according to the present exemplary embodiment is not limited to the above-described example, and the present exemplary embodiment can be applied to a recording head using a piezoelectric element, an electrostatic element, or the like.

The carriage 102 is connected to a part of a drive belt 107 of the transmission mechanism 104 that transmits the driving force of the carriage motor M1 to the carriage 102, and is guided and supported to be slidable in the X direction along a guide shaft 113. The carriage 102 is caused to reciprocate along the guide shaft 113 by forward and reverse rotation of the carriage motor M1. A scale 108 (carriage (CR) encoder film) for indicating an absolute position of the carriage 102 is provided along the scanning direction (i.e., X direction) of the carriage 102. The scale 108 according to the present exemplary embodiment is a transparent polyethylene terephthalate (PET) film on which black bars are printed at a predetermined pitch. One side of the scale is fixed to a chassis 109, and the other side is supported by a leaf spring (not illustrated).

The recording apparatus 100 includes a platen (not illustrated) at a position facing an ejection port surface of the recording head 103 on which the ejection ports are formed. The carriage 102 with the recording head 103 mounted thereon is caused to reciprocate by the driving force of the carriage motor M1, and at the same time, ink droplets are ejected from the recording head 103 to record an image on the recording medium P conveyed on the platen. In addition, preliminary ejection for ejecting ink to the platen is performed in order to suppress an ejection failure caused by thickening of ink due to drying. The preliminary ejection is an ejection operation of ink not used for recording an image and is performed on an area outside the recording medium P.

The carriage 102 with the recording head 103 mounted thereon is connected to the carriage motor M1 via the drive belt 107 and can reciprocate in the X direction illustrated in FIG. 1. One of standby positions of the recording head 103 is referred to as a home position, and the other on an opposite side across the recording medium P is referred to as a back position. A position of the carriage 102 is managed using the scale 108 arranged along the X direction, namely the scanning direction. The position of the carriage 102 is managed by optically reading the scale 108 with an encoder sensor (not illustrated) provided in the carriage 102. A speed of the carriage 102 is managed by measuring a time when the carriage 102 passes the scale 108. In addition, a target speed is set for each position of the carriage 102 so that the speed of the carriage 102 is increased to reach a constant speed. A timing for ejecting ink droplets from the recording head 103 (hereinafter also referred to as an ejection timing) is determined based on a read pulse output from the encoder sensor. The landing positions of ink droplets on the recording medium P are adjusted by delaying or advancing the ejection timing during scanning of the carriage 102 using a parameter for controlling the ejection timing.

A conveyance roller 114 in FIG. 1 is driven by a conveyance motor M2 to convey the recording medium P. A pinch roller 115 brings the recording medium P into contact with the conveyance roller 114 using a spring (not illustrated). A pinch roller holder 116 rotatably supports the pinch roller 115. A conveyance roller gear 117 is fixed to one end of the conveyance roller 114. The conveyance roller 114 is driven by rotation of the conveyance motor M2 transmitted to the conveyance roller gear 117 via an intermediate gear (not illustrated).

An ejection roller 120 ejects the recording medium P on which an image is formed by the recording head 103, to the outside of the recording apparatus 100. The ejection roller 120 is driven by transmission of rotation of the conveyance motor M2 to the ejection roller 120. A spur roller (not illustrated) brings the recording medium P into a pressure contact with the ejection roller 120 using a spring (not illustrated). A spur holder 122 rotatably supports the spur roller.

The recording apparatus 100 is provided with the recovery device 110 for recovering an ejection failure of the recording head 103. The recovery device 110 is mounted at a position outside a reciprocating movement area (recording area) for a recording operation of the carriage 102 on which the recording head 103 is mounted, for example, a position corresponding to the home position as illustrated in FIG. 1.

The recovery device 110 includes a capping mechanism 111 for capping the ejection port surface of the recording head 103 and a wiping mechanism 112 for cleaning the ejection port surface of the recording head 103. The recovery device 110 performs the ejection recovery processing, such as forcibly ejecting ink from the ejection ports using a suction pump or the like provided in the recovery device 110 to remove thickened ink, air bubbles, or the like from an ink flow passage of the recording head 103, in conjunction with capping of the ejection port surface using the capping mechanism 111.

In addition, the ejection port surface of the recording head 103 is capped by the capping mechanism 111 at the time of a non-recording operation or the like, so that the ejection port surface can be protected, and evaporation and drying of moisture in the ink can be suppressed. The wiping mechanism 112 is arranged near the capping mechanism 111 and can wipe off ink droplets adhering to the ejection port surface of the recording head 103. The capping mechanism 111 and the wiping mechanism 112 can maintain a normal ejection state of ink from the recording head 103.

Figure 2:
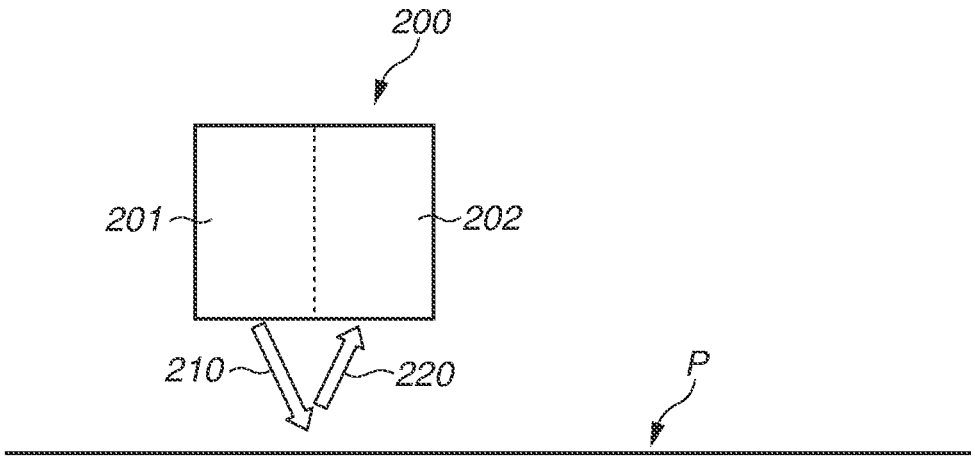
FIG. 2 is a diagram illustrating a schematic configuration of an optical sensor of the recording apparatus.

FIG. 2 is a diagram illustrating a schematic configuration of an optical sensor of the recording apparatus 100 according to the present exemplary embodiment. The carriage 102 mounts thereon a reflection type optical sensor 200 (hereinafter referred to as an optical sensor) in addition to the recording head 103 and the ink cartridges 106. The optical sensor 200 is capable of obtaining an optical characteristic and optically reads a test pattern recorded on the recording medium P and measures a recording density of the test pattern.

The optical sensor 200 includes a light emitting unit 201 implemented by a light-emitting diode (LED) and the like and a light receiving unit 202 implemented by a photodiode and the like. Irradiation light 210 emitted from the light emitting unit 201 is reflected on the recording medium P, and reflected light 220 thereon enters the light receiving unit 202. The light receiving unit 202 converts the received reflected light 220 into an electrical signal.

In measurement of the recording density of the test pattern, conveyance of the recording medium P in the conveyance direction (hereinafter referred to as the Y direction) and movement of the carriage 102 provided with the optical sensor 200 in the X direction are alternately performed. This measurement operation enables the optical sensor 200 to detect the density of a test pattern group recorded on the recording medium P as optical reflectance. As the light emitting unit 201, a white LED or a three-color LED of red, blue, and green is used in order to measure the density of the test pattern recorded with the cyan, magenta, yellow, and black inks and the like according to the present exemplary embodiment. As the light receiving unit 202, a photodiode having sensitivity in a visible light region is used. In the present exemplary embodiment, it is only necessary to confirm a relative density between a plurality of patches arranged in the X direction, and the optical sensor 200 does not necessarily have to be able to obtain an accurate absolute density. However, it is desirable that the optical sensor 200 has a resolution sufficient to detect a relative density between patches in a patch area, and that detection sensitivity of the optical sensor 200 is sufficiently stable while the carriage 102 is scanning in the X direction.

Figure 3:
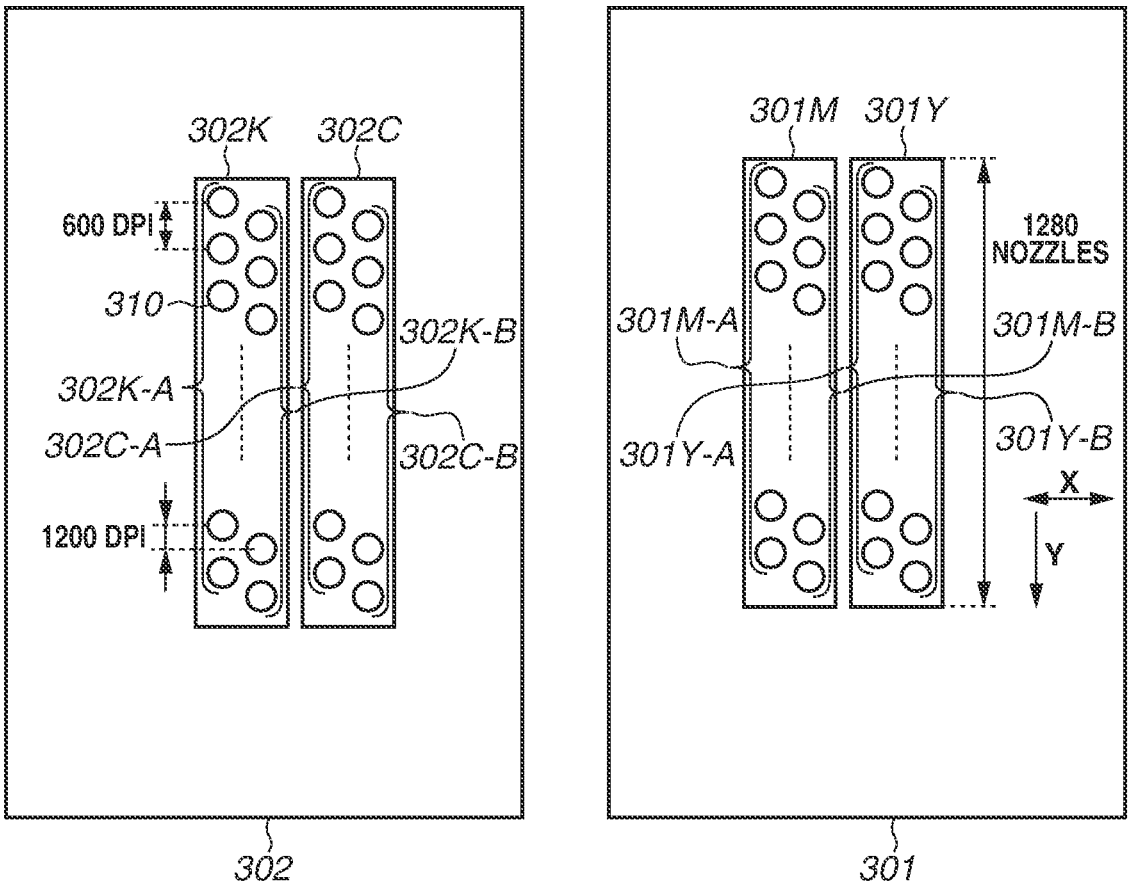
FIG. 3 is a diagram illustrating an array configuration of ejection ports provided on an ejection port surface of a recording head.

FIG. 3 illustrates an array configuration of the ejection ports (hereinafter also referred to as the nozzles) provided on the ejection port surface of the recording head 103. The recording head 103 includes two head chips 301 and 302 that are arranged side by side in the X direction. The head chip 301 includes a yellow ink ejection port array 301Y in which ejection ports for ejecting the yellow ink are arranged along the Y direction, and a magenta ink ejection port array 301M in which ejection ports for ejecting the magenta ink are arranged along the Y direction. The yellow ink ejection port array 301Y and the magenta ink ejection port array 301M are arranged side by side along the X direction. The head chip 302 includes a cyan ink ejection port array 302C in which ejection ports for ejecting the cyan ink are arranged along the Y direction, and a black ink ejection port array 302K in which ejection ports for ejecting the black ink are arranged along the Y direction. The cyan ink ejection port array 302C and the black ink ejection port array 302K are arranged side by side along the X direction. In each of the ejection port arrays 301Y, 301M, 302C, and 302K, the ejection ports are arranged at a predetermined spacing along the Y direction. In addition, each of the ejection port arrays 301Y, 301M, 302C, and 302K includes an Odd array having odd-numbered ejection ports and an Even array having even-numbered ejection ports. For the black, cyan, magenta, and yellow inks, the Odd arrays 302K-A, 302C-A, 301M-A, and 301Y-A and the Even arrays 302K-B, 302C-B, 301M-B, and 301Y-B are provided, respectively. For example, in each of the Odd array and the Even array, 640 ejection ports are arranged at a spacing corresponding to 600 dots per inch (dpi), and the ejection ports of the Even array and the Odd array are shifted from each other by a distance corresponding to 1200 dpi in the Y direction. Thus, although each of the Odd array and the Even array has a resolution of 600 dpi in the Y direction, a recording resolution of 1200 dpi is achieved in the Y direction by shifting the ejection ports of the Even array and the Odd array from each other.

Figure 4:
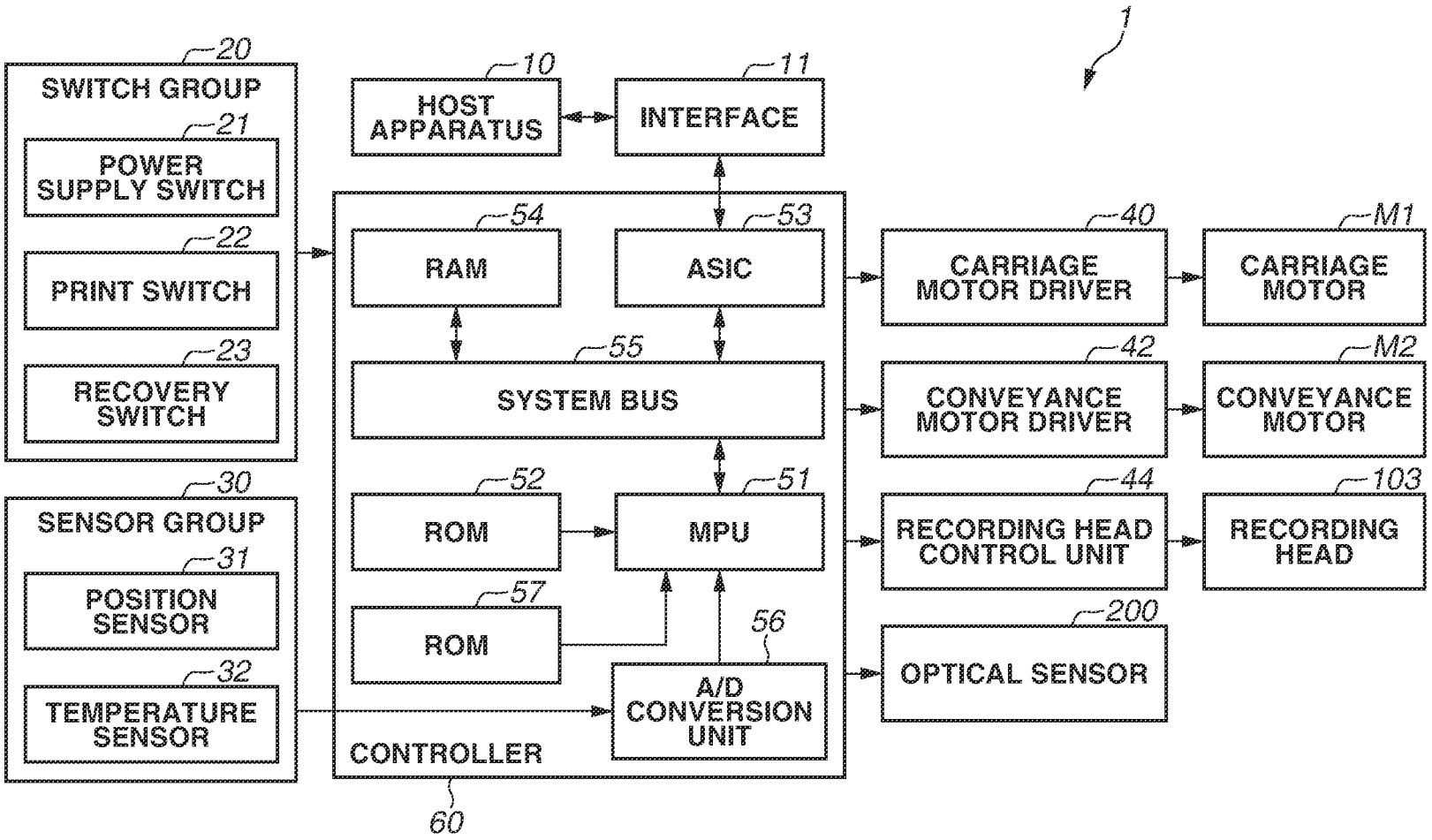
FIG. 4 is a block diagram illustrating a control configuration of the recording apparatus.

FIG. 4 is a block diagram illustrating a control configuration of the recording apparatus 100 according to the present exemplary embodiment. A controller 60 includes a micro processing unit (MPU) 51, a read-only memory (ROM) 52, a ROM 57, an application specific integrated circuit (ASIC) 53, a random access memory (RAM) 54, a system bus 55, and an analog/digital (A/D) conversion unit 56. Each of the ROMs 52 and 57 stores a program corresponding to a control sequence (described below), a required table, and other fixed data. The ROM 52 is rewritable and is, for example, an electrically erasable and programmable read-only memory (EEPROM).

The ASIC 53 controls the carriage motor M1 and the conveyance motor M2. In addition, the ASIC 53 generates a control signal for controlling the recording head 103. The RAM 54 is used as an area for loading image data and a work area for executing a program. The system bus 55 connects the MPU 51, the ASIC 53, and the RAM 54 with each other to transmit and receive data therebetween. The A/D conversion unit 56 converts an analog signal input from a sensor group (described below) into a digital signal, and supplies the digital signal to the MPU 51.

The MPU 51 controls the entire operation of the recording apparatus 100. For example, the MPU 51 calculates and generates a registration adjustment value based on a measurement result of a test pattern (described below) in registration adjustment processing. The registration adjustment value is, for example, temporarily stored in the RAM 54 and then stored in the ROM 52. In addition, the MPU 51, for example, adjusts the ejection timing of ink ejected from each of the ejection ports based on the registration adjustment value stored in the RAM 54. Accordingly, the landing positions of dots to be formed on the recording medium P can be corrected. The ROM 52 holds the type of the recording medium P, and thickness data determined by measuring the recording medium P in advance. The ROM 52 further holds a rough estimate of thickness of the recording medium P of which thickness data is not determined.

A switch group 20 includes a power supply switch 21, a print switch 22, and a recovery switch 23. A sensor group 30 for detecting the state of the recording apparatus 100 includes a position sensor 31 and a temperature sensor 32. The ASIC 53 transfers data for driving the recording elements (ejection heaters) to the recording head 103 while directly accessing the storage area of the RAM 54 in scanning of the recording head 103.

A recording head control unit 44 controls a recording operation performed by the recording head 103. The carriage motor M1 is a driving source for causing the carriage 102 to reciprocate and scan in a predetermined direction, and a carriage motor driver 40 controls driving of the carriage motor M1. The conveyance motor M2 is a driving source for conveying the recording medium P, and a conveyance motor driver 42 controls driving of the conveyance motor M2.

A host apparatus 10 is a computer as a supply source of image data, a reader for reading an image, a digital camera, or the like. The host apparatus 10 and the recording apparatus 100 transmit and receive image data, a command, a status signal, and the like therebetween via an interface (hereinafter referred to as an I/F) 11. The host apparatus 10 includes a printer driver that holds the type of the recording medium P and the thickness data determined by measuring the recording medium P in advance. In addition, the printer driver holds a rough estimate of the thickness of the recording medium P of which thickness data is not determined.

Next, a configuration of the test pattern for determining the registration adjustment value will be described with reference to FIGS. 5 to 7. The registration adjustment value indicates a correction amount for correcting the ejection timing of ink droplets. The ejection timing of ink droplets from each of the ejection port arrays is controlled based on the registration adjustment value.

Figure 5:
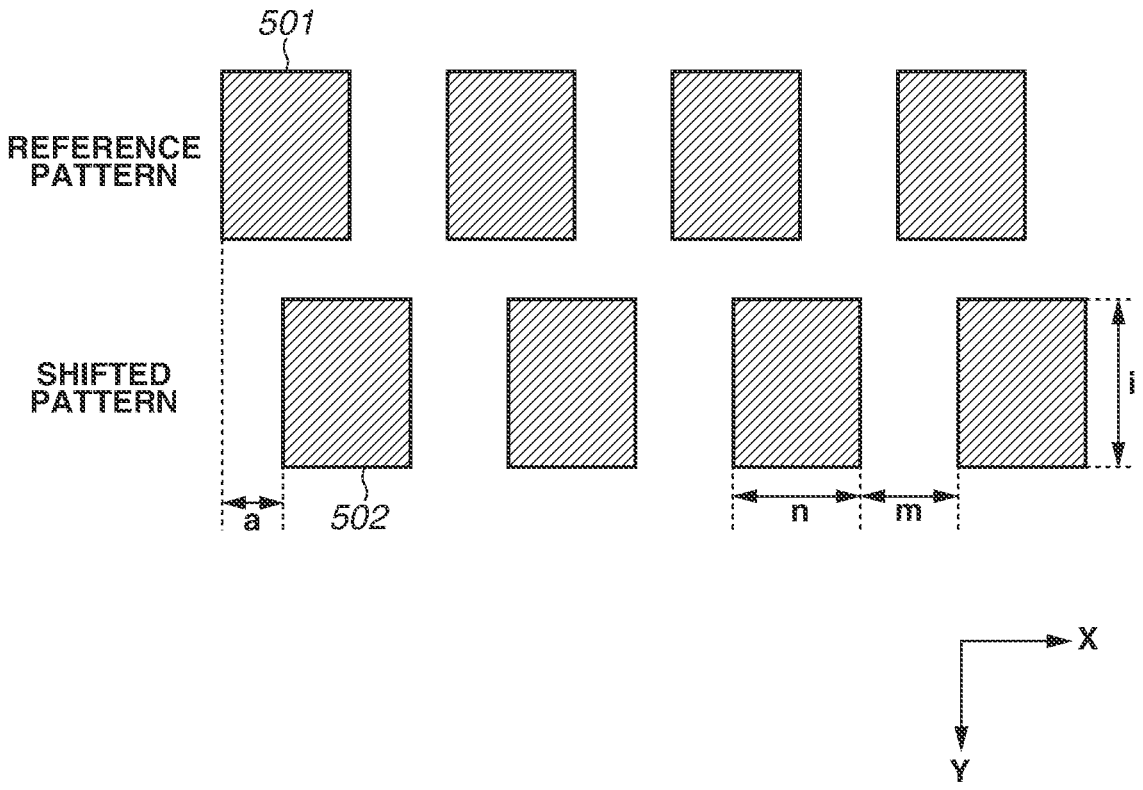
FIG. 5 is a diagram illustrating a test pattern used for registration adjustment.

FIG. 5 is a diagram illustrating a configuration example of the test pattern used for registration adjustment according to the present exemplary embodiment. Rectangle patterns (hereinafter also referred to as patches) each having "i"×"n" pixels are arranged in a periodic, repeated manner with an "m" pixel blank area therebetween in the X direction. Registration adjustment is performed by detecting the density of each of the patches using the optical sensor 200. One rectangle pattern (patch) includes a reference pattern 501 and a shifted pattern 502. The recording position of the shifted pattern 502 is shifted by a predetermined number "a" of pixels (hereinafter referred to as a shift amount "a") from the recording position of the reference pattern 501. For convenience of description, the reference pattern 501 and the shifted pattern 502 in FIG. 5 are shifted from each other in a vertical direction, but when patches are actually recorded, the reference pattern 501 and the shifted pattern 502 are recorded so as to overlap each other. More specifically, the reference pattern 501 is recorded so as to overlap with the shifted pattern 502 that is shifted by the shift amount "a" in the X direction, as the patch to be used for registration adjustment.

The registration adjustment according to the present exemplary embodiment is to adjust recording timings between two ejection port arrays by forming the reference pattern 501 and the shifted pattern 502 using different ejection port arrays. Which combination of ejection port arrays is used for recording is determined depending on the adjustment target such as the registration adjustment between the ink colors or the registration adjustment in bidirectional recording. For example, in the case of the registration adjustment between the ink colors, the reference pattern 501 is formed using a reference ejection port array (e.g., the Odd array 302K-A for the black ink), and the shifted pattern 502 is formed to overlap with the reference pattern 501 using another ejection port array (e.g., the Odd array 302C-A for the cyan ink). The same can be applied to the registration adjustment in the bidirectional recording. For example, using the Odd array 302K-A, the reference pattern 501 is formed in forward direction scanning and the shifted pattern 502 is formed in reverse direction scanning. The registration adjustment in the bidirectional recording can thus be performed using the Odd array 302K-A for the black ink. The registration adjustment can be performed not only in the X direction but also in the Y direction, and the combination of ejection port arrays used for recording the reference pattern 501 and the shifted pattern 502 is not limited to the above-described example. Furthermore, the resolution of each of the reference pattern 501 and the shifted pattern 502 and the shift amount "a" can be determined based on recording resolution of the recording apparatus 100. The recording resolution according to the present exemplary embodiment is 1200 dpi.

Figure 6:
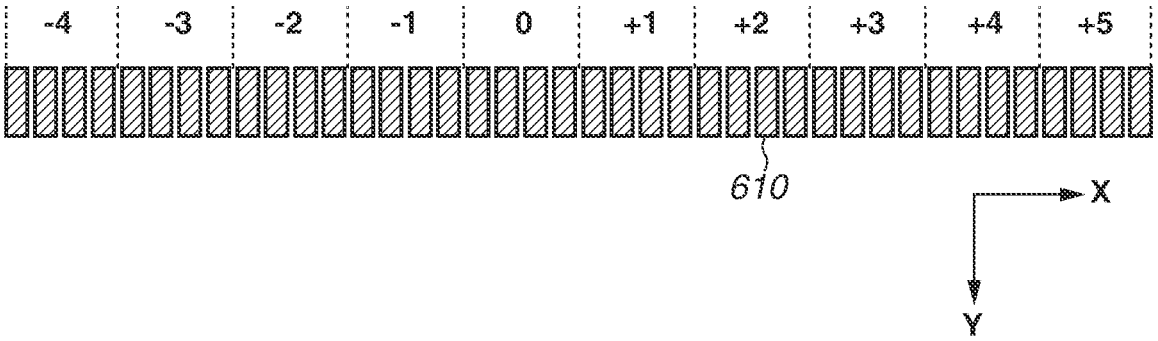
FIG. 6 is a diagram illustrating an example of the test pattern.

FIG. 6 is a diagram illustrating an example of the test pattern in which a plurality of rectangle patterns is arranged in the X direction. In FIG. 6, a patch group 610 includes ten types of patches that are obtained by changing the shift amount "a" of the shifted pattern 502 from −4 pixels to +5 pixels. For each shift amount "a", four patches are recorded. FIG. 6 is an example of a case where the recording positions match each other between the ejection port array used to record the reference pattern 501 and the ejection port array used to record the shifted pattern 502. More specifically, in a case where the shift amount "a" is zero, the reference pattern 501 and the shifted pattern 502 are recorded to overlap each other. On the other hand, the further the shift amount "a" is away from zero, the larger the deviation of the shifted pattern 502 from the reference pattern 501 is. As a result, the width of the patch in the X direction is narrowest in a case where the shift amount "a" is zero, and becomes wider as the shift amount "a" is further away from zero. As described above, FIG. 6 is the example of the case where the recording positions match each other between the ejection port arrays. However, actually, there is a possibility of a deviation between the recording positions, and the shift amount "a" with which the patch width is narrowest is not always zero. If the recording positions of ink droplets from the ejection port array used to form the shifted pattern 502 are deviated from the recording positions of ink droplets from the ejection port array used to form the reference pattern 501, an area ratio of ink with respect to the recording medium P is changed.

Figure 7:
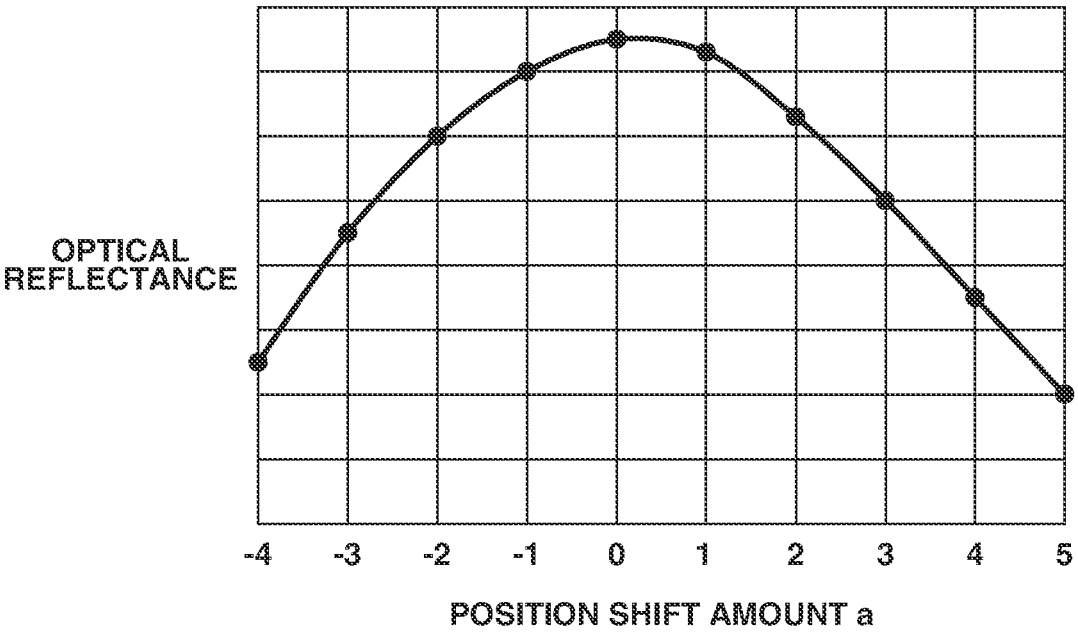
FIG. 7 is a graph illustrating a measurement result of the test pattern.

FIG. 7 is a graph illustrating a result of measuring the test pattern illustrated in FIG. 6 using the optical sensor 200. The horizontal axis represents the shift amount "a", and the vertical axis represents the optical reflectance. The density is in an inverse relationship with the optical reflectance. In recorded patches, the smaller the deviation of the recording position of the shifted pattern 502 from the recording position of the reference pattern 501 is, the lower the density is. Therefore, since a patch having higher optical reflectance has a smaller recording position deviation amount, the shift amount "a" of the patch having the lowest density can be used as the registration adjustment value. In this way, the registration adjustment value can be generated based on the measurement result of the test pattern.

The number of patches and the shift amount "a" in the test pattern can be determined based on an adjustment range required by mechanical tolerances of the recording apparatus 100 and a unit of shift amount of the recording position, and can be determined according to accuracy of the registration adjustment processing. In addition, the recording area can be determined based on the size of an area detectable by the optical sensor 200, the width in the scanning direction of an area recordable in a single recording scan operation, the size of each patch, the size of a recordable area in the recording medium P, and the like.

Figure 8A:
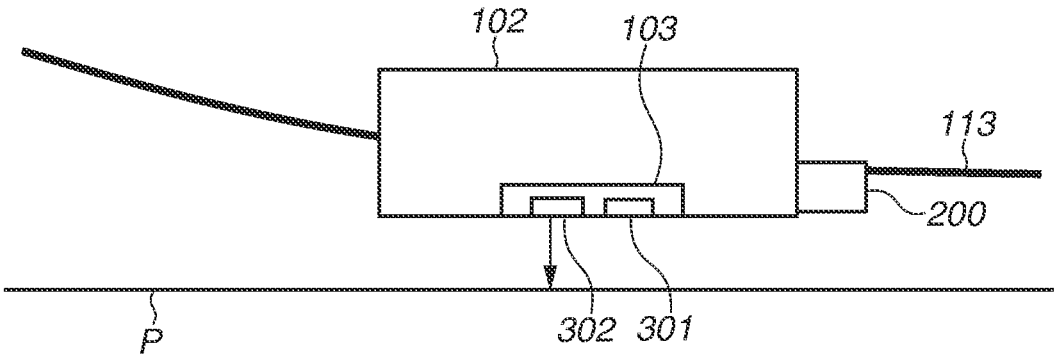
FIGS. 8A and 8B are schematic diagrams illustrating a variation in posture of a carriage.
Figure 8B:
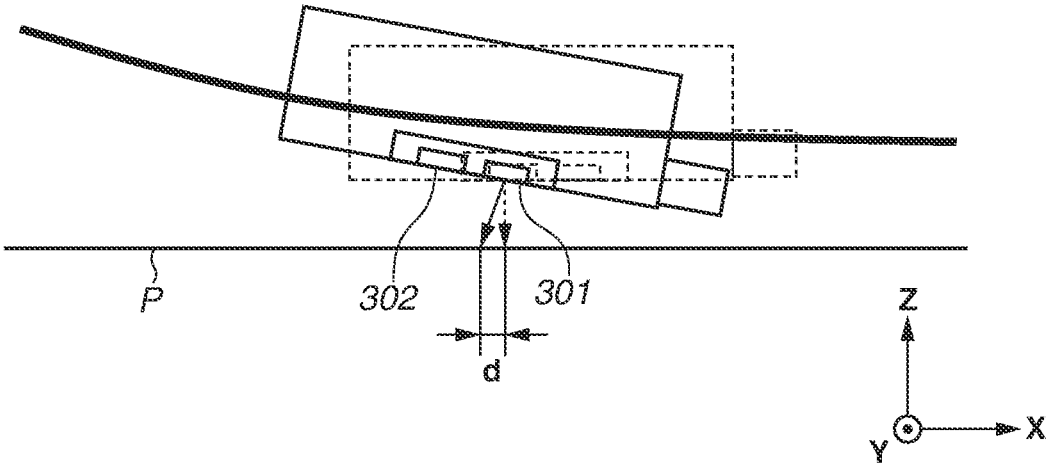

FIGS. 8A and 8B are schematic diagrams illustrating variation in posture of the carriage 102 that is a cause of a deviation between the recording positions, and illustrating a case where the carriage 102 in FIG. 1 is observed from the Y direction. The recording head 103 mounted on the carriage 102 includes the head chips 301 and 302. Even if ink droplets are ejected vertically from the ejection port surface of the head chip 301, the landing positions (recording positions) of ink droplets on the recording medium P are deviated in the scanning direction from positions at which an ejection operation is performed, due to a scanning velocity component of the carriage 102. If the ejection port surface and the surface of the recording medium P are always parallel and maintain a constant distance therebetween, a deviation amount "d" in the scanning direction is maintained at a constant level. However, there is a case where the deviation amount "d" is not maintained at a constant level and thus the recording positions of ink droplets from the head chip 301 and the recording positions of ink droplets from the head chip 302 are deviated from each other.

For example, a case where the guide shaft 113 is curved as illustrated in FIG. 8B will be described. FIG. 8A illustrates the posture of the carriage 102 in a case where the ejection port surface of the head chip 302 faces a certain position on the recording medium P. In FIG. 8A, the ejection port surface of the head chip 302 is parallel to the recording medium P. FIG. 8B illustrates the posture of the carriage 102 in a case where the carriage 102 in the state illustrated in FIG. 8A is caused to scan and the ejection port surface of the head chip 301 faces the same position in FIG. 8A. In FIG. 8B, the ejection port surface of the head chip 301 is inclined with respect to the recording medium P.

As described above, the ejection direction of ink droplets ejected from the ejection port surface varies depending on the position of the carriage 102 in the X direction, which causes a variation in the deviation amount "d" of the recording position. Thus, an appropriate value of a difference between the ejection timings for ejecting ink droplets onto the same position of the recording medium P using the ejection port array disposed on the head chip 301 and the ejection port array disposed on the head chip 302 varies depending on the position in the X direction. If the registration adjustment value is set to be constant regardless of the position in the X direction, a difference between the ejection timings of the two ejection port arrays is constant. However, a position at which the recording positions of dots match each other and a position at which the recording positions do not match each other are mixed in the X direction, which can be visually recognized as a color misregistration. Therefore, it is necessary to set the registration adjustment value depending on the position in the X direction.

The deviation between the recording positions described above occurs not only in a case where dots are recorded in single scanning of the carriage 102 using a plurality of the ejection port arrays but also in a case where the bidirectional recording is performed, more specifically, dots are recorded in both the forward direction scanning and the reverse direction scanning. For example, there is a deviation between the recording positions in the forward direction scanning and the reverse direction scanning that are performed using a certain single ejection port array, namely a bidirectional recording position deviation.

Figure 9:
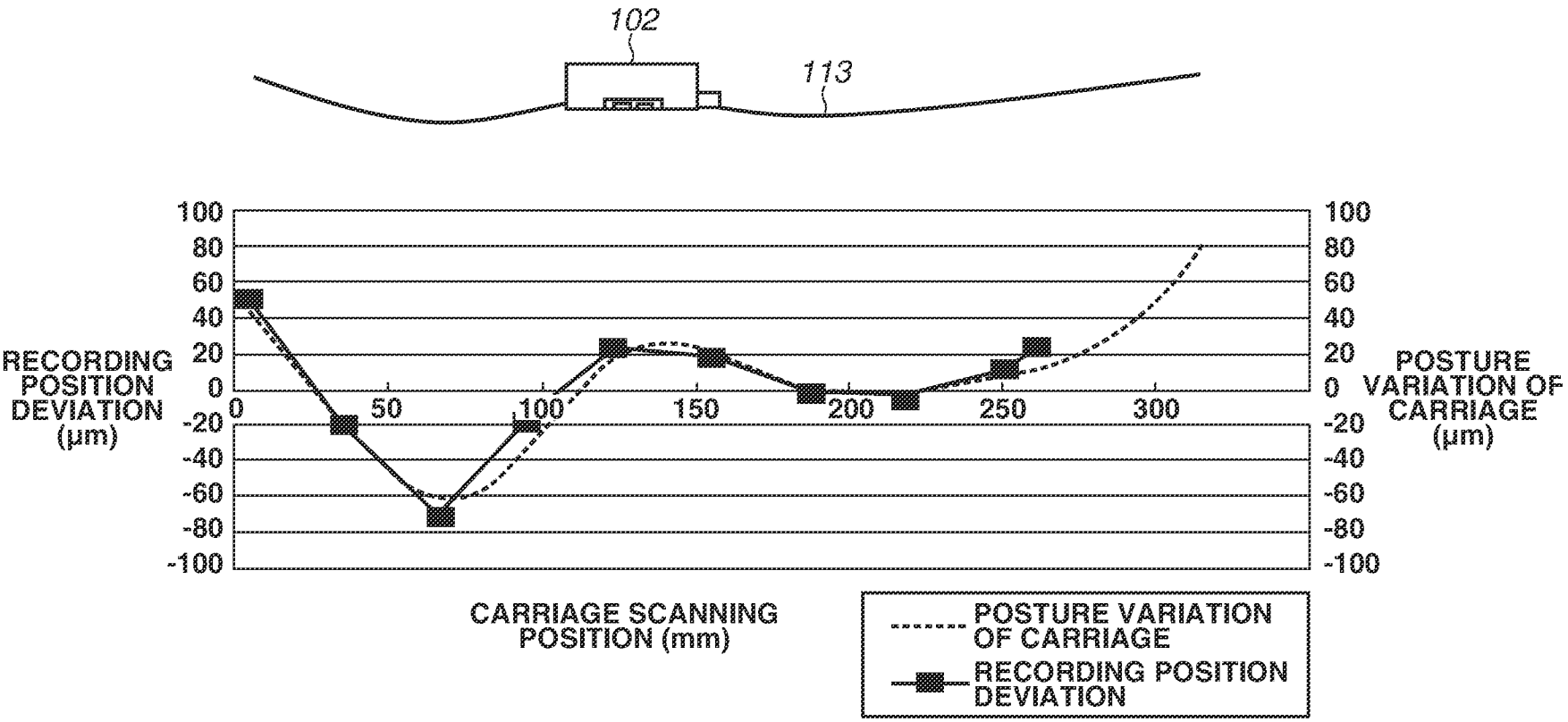
FIG. 9 is a diagram illustrating a bidirectional recording position deviation in the recording apparatus.

FIG. 9 is a diagram illustrating the bidirectional recording position deviation in the recording apparatus 100 according to the present exemplary embodiment, and illustrating a result of measuring a posture variation amount (inclination amount) of the carriage 102 and a deviation amount of the recording position at each scanning position of the carriage 102 in the X direction. As illustrated in FIG. 9, there is a correlation between the posture variation amount of the carriage 102 and the recording position deviation. In most cases, the variation in the posture of the carriage 102 is caused by curvature of the guide shaft 113, and the curvature itself is unlikely to change with time. Thus, the registration adjustment value, which is a correction amount for correcting the recording position deviation, can be used without being changed for a long period of time.

Figure 10:
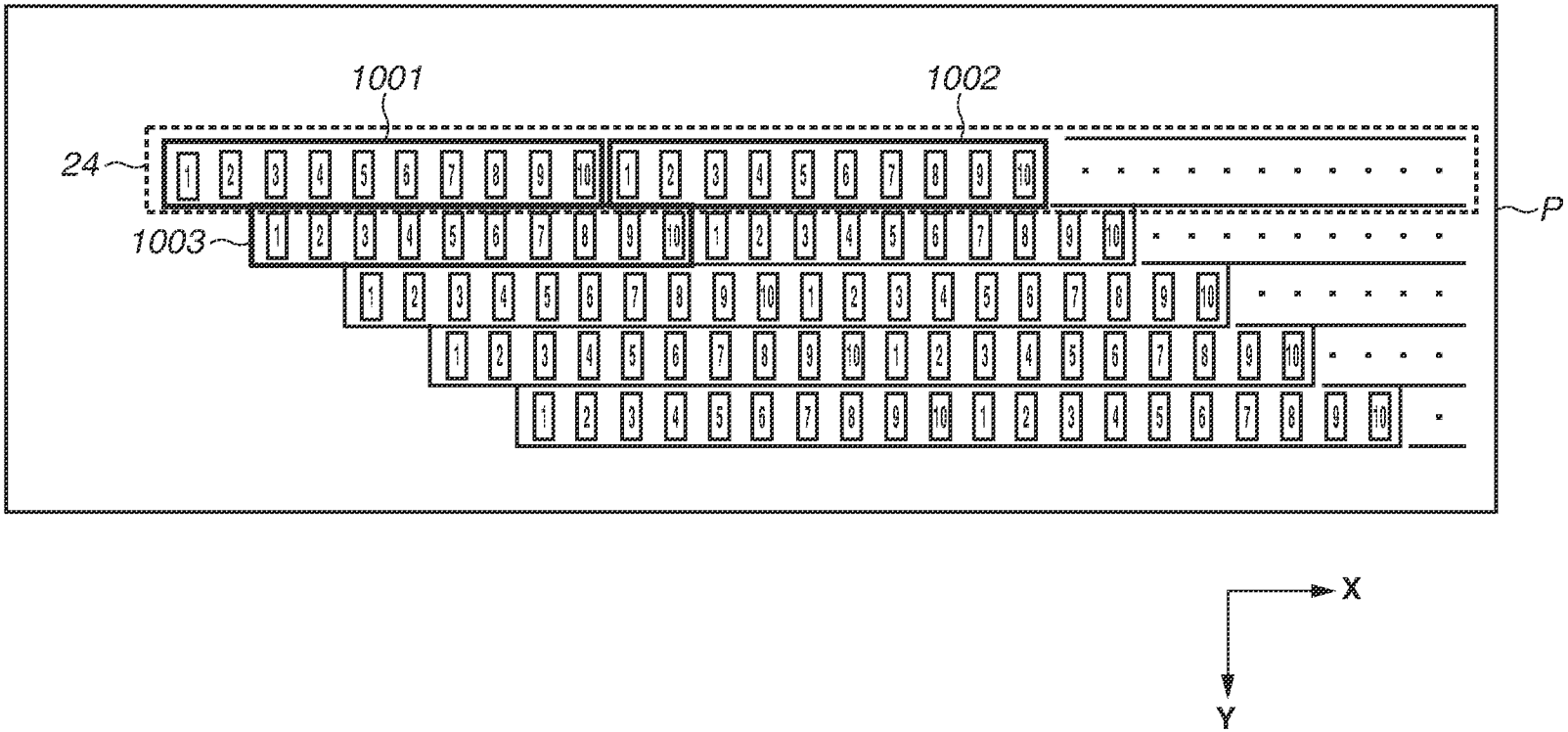
FIG. 10 is a schematic diagram illustrating the test pattern for registration adjustment.

FIG. 10 is a schematic diagram illustrating the test pattern for the registration adjustment according to the present exemplary embodiment. The ten types of patches 1 to 10 each having a different shift amount "a", which have been described with reference to FIGS. 5 and 6, are arranged in the X direction. A plurality of patch groups, such as patch groups 1001 and 1002, each including the ten types of patches 1 to 10 is arranged in the X direction. In FIG. 10, two patch groups are illustrated in each row in the horizontal direction (X direction). However, actually, as many patch groups as possible are arranged side by side in the entire area of the recording medium P in the X direction, so that a line patch extending in the X direction is formed. A line patch 24 includes a plurality of patch groups arranged in the row including the patch group 1001. The controller 60 measures the density of each patch and calculates a recording position deviation amount for each patch group. In the test pattern according to the present exemplary embodiment, a patch group 1003 is recorded at a position shifted from the patch group 1001 by two patches in the X direction and by one patch in the Y direction. In a similar manner, patch groups are recorded in five rows in the Y direction.

Figure 11:
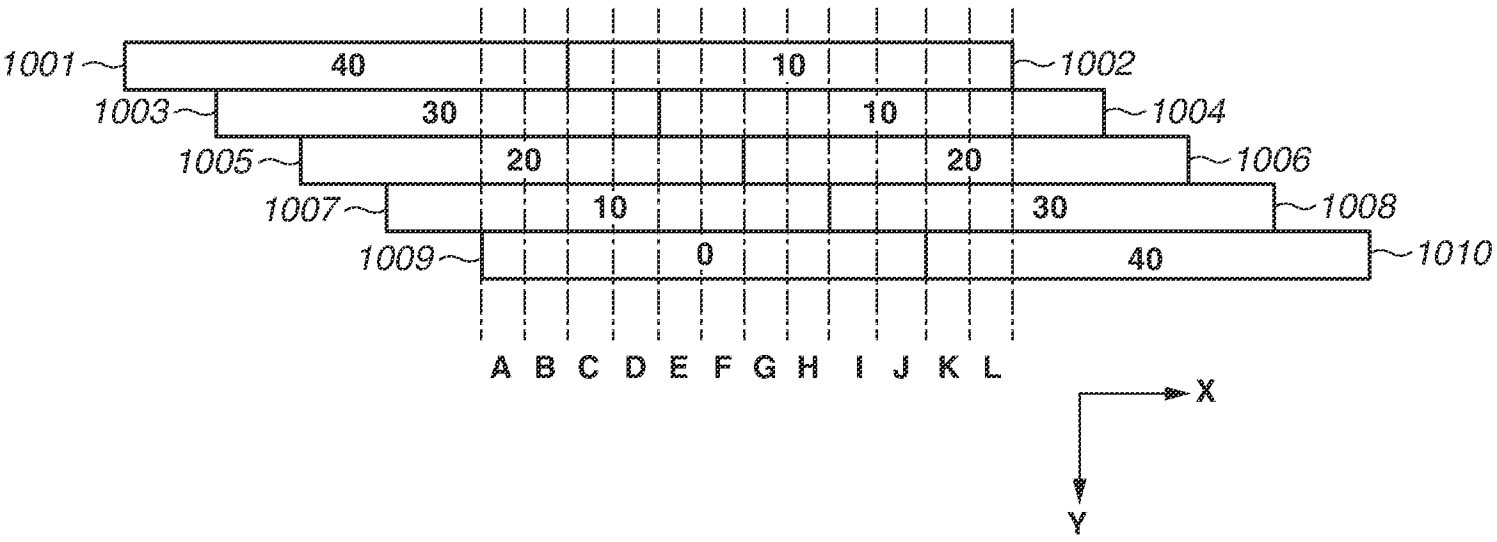
FIG. 11 is a schematic diagram illustrating a method for calculating a recording position deviation.

FIG. 11 is a schematic diagram illustrating a method for calculating the recording position deviation at an arbitrary position in the X direction by using the test pattern for the registration adjustment according to the present exemplary embodiment. As described above, the controller 60 calculates the registration adjustment value corresponding to each patch group. In FIG. 11, the registration adjustment value corresponding to each patch group is indicated. The registration adjustment value at a position A in the X direction is calculated by averaging the registration adjustment values of the corresponding five patch groups 1001, 1003, 1005, 1007, and 1009. In the example illustrated in FIG. 11, the registration adjustment value at the position A is calculated as 20 μm ((40 μm+30 μm+20 μm+10 μm+0 μm)/5). The registration adjustment value at a position F is an average of the registration adjustment values of the corresponding patch groups 1002, 1004, 1005, 1007, and 1009, and is calculated as 10 μm ((10 μm+10 μm+20 μm+10 μm+0 μm)/5). In this manner, the registration adjustment value is calculated for each position in the X direction. The registration adjustment values at positions B and C may be same as those at the positions A and D, or internally divided values corresponding to distances in the X direction may be calculated from the registration adjustment values at the positions A and D.

Figure 12A:
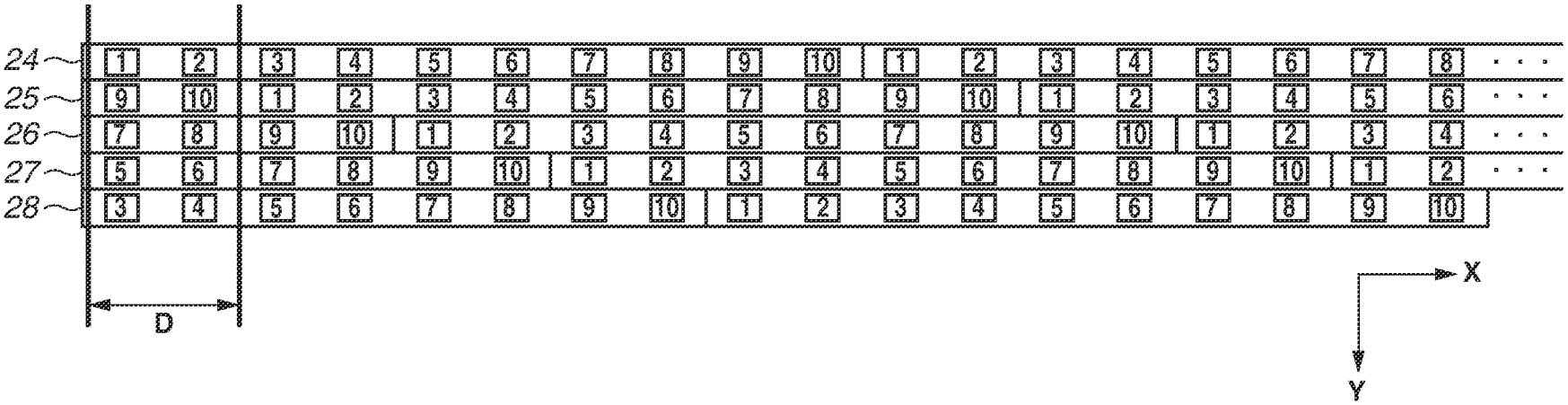
FIGS. 12A and 12B illustrate patches of the test pattern.
Figure 12B:
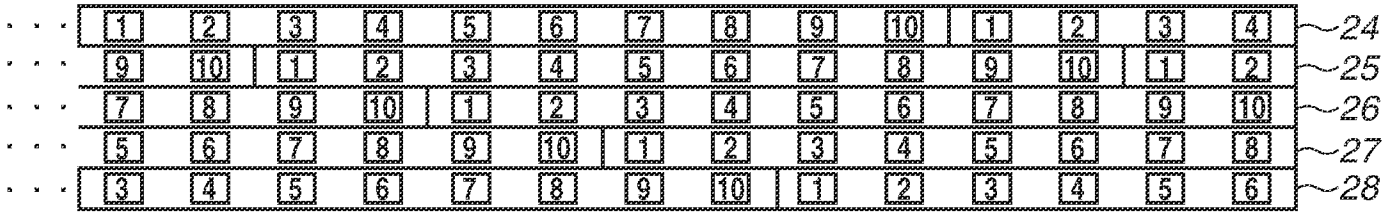

FIGS. 12A and 12B are diagrams illustrating examples of the patches 1 to 10 at both ends of the test pattern. FIGS. 12A and 12B illustrate examples of the recording positions of the patches 1 to 10 at the left end and the right end, respectively. In FIG. 12A, the patch 1 is arranged at the left end of the line patch 24, followed by the patches 2, 3, 4 through 10, and then patches are arranged again in order from the patch 1 to the patch 10. In a line patch 25, the patch 9 is arranged at the left end, followed by the patch 10, and then patches are arranged again in order from the patch 1 to the patch 10. Similarly, in line patches 26 to 28, the patches each having the number shifted by 2 in the Y direction are arranged at the left end and then the ten types of patches 1 to 10 are sequentially arranged. In this way, the five line patches 24 to 28 are arranged so that the patch numbers are shifted by two in the Y direction. Accordingly, the patches 1 to 10 are included in the left end area having a width D of two patches. Thus, the registration adjustment value at the left end area can be calculated from a measurement result of the ten patches included in the area having the width D. Similarly, as illustrated in FIG. 12B, the patches 1 to 10 are arranged by the line patches 24 to 28 in the right end area of the test pattern having the width D of two patches, and thus the registration adjustment value can be calculated from a measurement result of the ten patches.

For a center portion other than the both ends in the X direction, the registration adjustment value is calculated from the ten patches arranged in each patch group in the X direction and then the registration adjustment value at each position is calculated from an average of the registration adjustment values corresponding to the five patch groups arranged in the Y direction. For each of the right and left ends, the registration adjustment value is calculated from the measurement result of the ten patches that are included in the width D and arranged in the Y direction.

In a case where the registration adjustment value is calculated, it is desirable to use the recording medium P having the maximum width in the X direction among recordable recording media sizes. With the test pattern recorded on the recording medium P having the maximum width, the registration adjustment value can be calculated in the entire area scannable by the recording head 103 mounted on the carriage 102, and the registration adjustment can be performed based on an actual measured value even in the case of the recording medium P having another size.

Figure 13A:
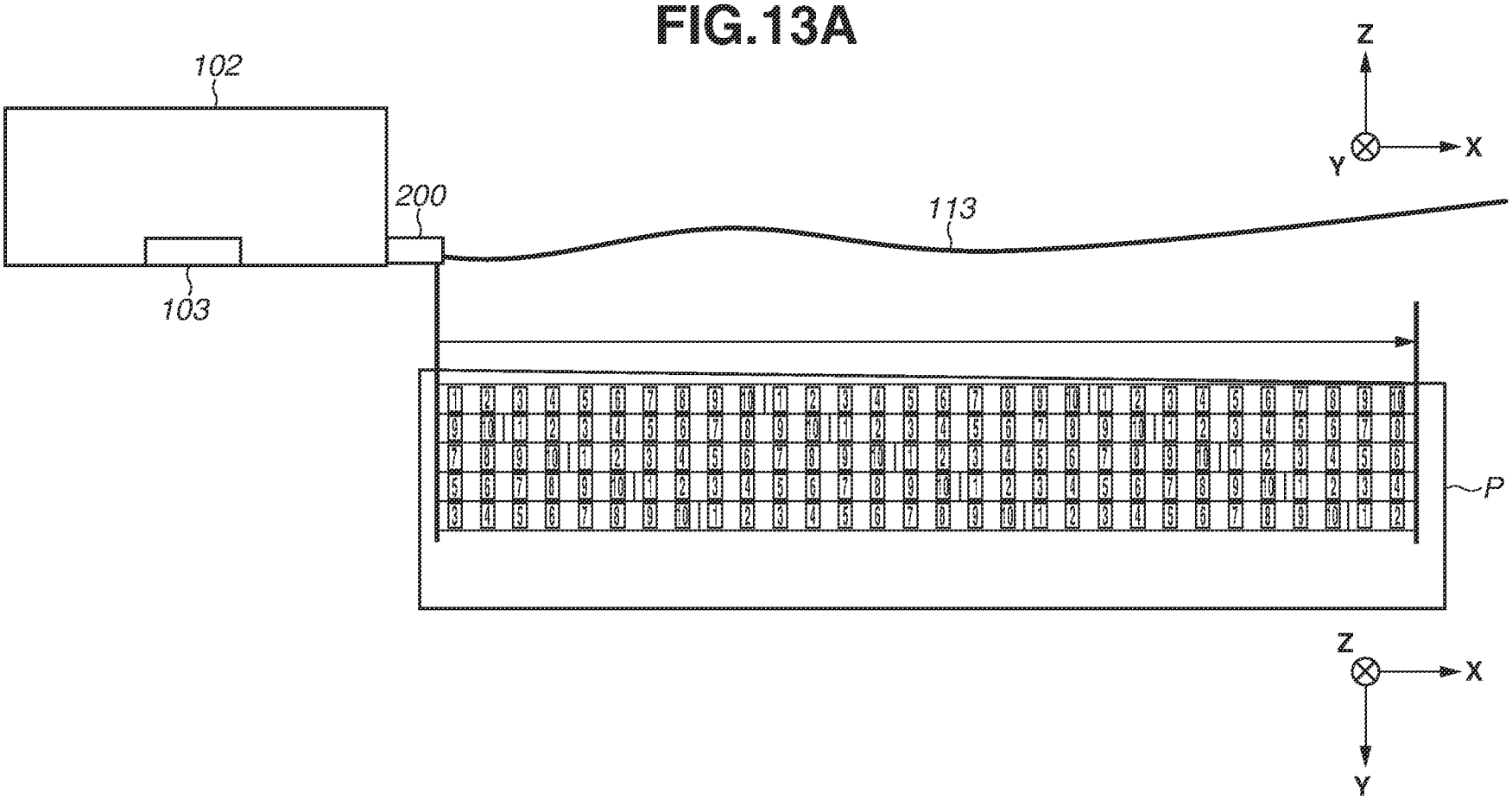
FIGS. 13A and 13B are schematic diagrams each illustrating a readable area of the optical sensor.
Figure 13B:
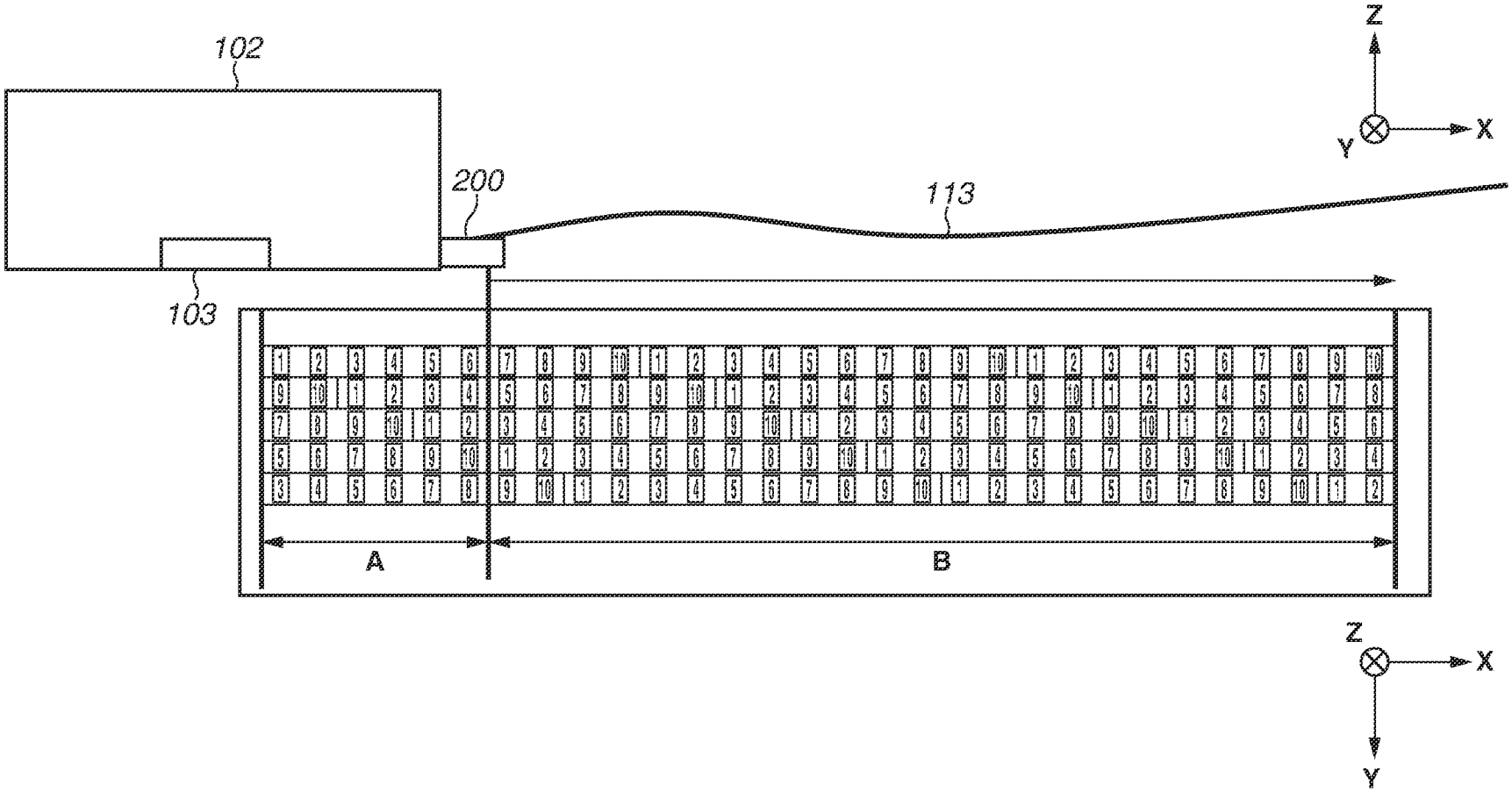

FIGS. 13A and 13B are schematic diagrams each illustrating an area readable by the optical sensor 200. As described above, an area that the recording head 103 mounted on the carriage 102 passes through is an image recordable area. Thus, the main body width of the recording apparatus 100 in the X direction can be minimized by designing the recording apparatus 100 to be able to scan the recording medium P that is supported by the recording apparatus 100 and has the maximum width in the X direction. In the present exemplary embodiment, FIGS. 13A and 13B each illustrate a positional relationship between the recording medium P having the maximum width recordable by the recording apparatus 100 and the carriage 102, and also illustrate a position of the carriage 102 that has moved furthest in the −X direction. In FIG. 13A, the recording head 103 is located at a position further away from an end (left end in FIG. 13A) of the recording medium P in the −X direction. In FIG. 13B, the recording head 103 is located at a position closer to the end of the recording medium P in the −X direction, as compared with FIG. 13A. In other words, the width of the left end of the main body of the recording apparatus 100 in the X direction can be designed to be smaller with the configuration of FIG. 13B than the configuration of FIG. 13A.

However, as illustrated in FIGS. 13A and 13B, the optical sensor 200 is mounted at a position separated from the recording head 103 in the +X direction. Thus, if the carriage 102 can move only to the position illustrated in FIG. 13B in the −X direction, the optical sensor 200 cannot pass over an area A in FIG. 13B and cannot read the patches recorded in the area A. An area B is an area recordable by the optical sensor 200. In the present exemplary embodiment, the area A includes patches from the patches at a home position end (hereinafter referred to as a left end) of the recording medium P to the sixth patches, and the area B includes patches from the seventh patches from the left end to the patches at a back position end (hereinafter referred to as a right end).

Figure 14:
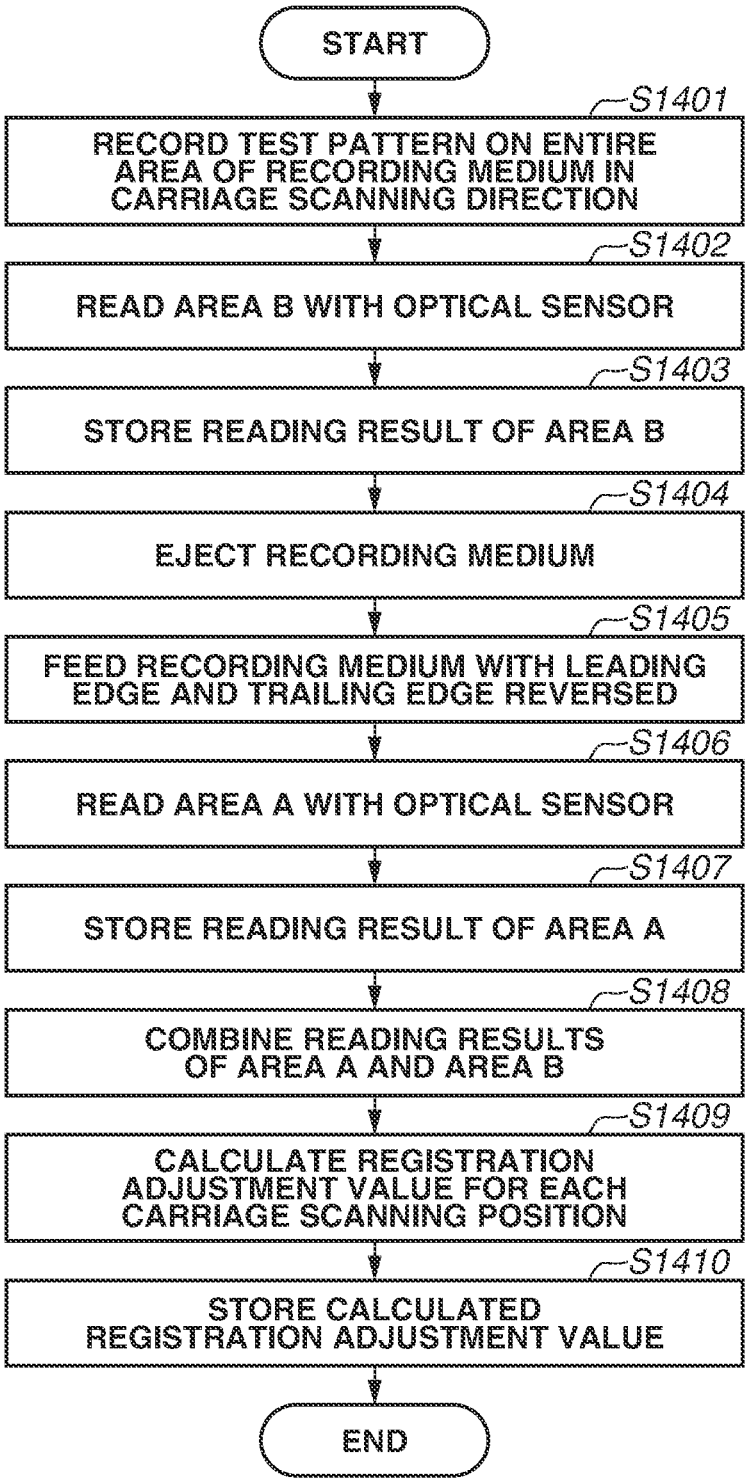
FIG. 14 is a flowchart illustrating registration adjustment value calculation processing.
Figure 15A:
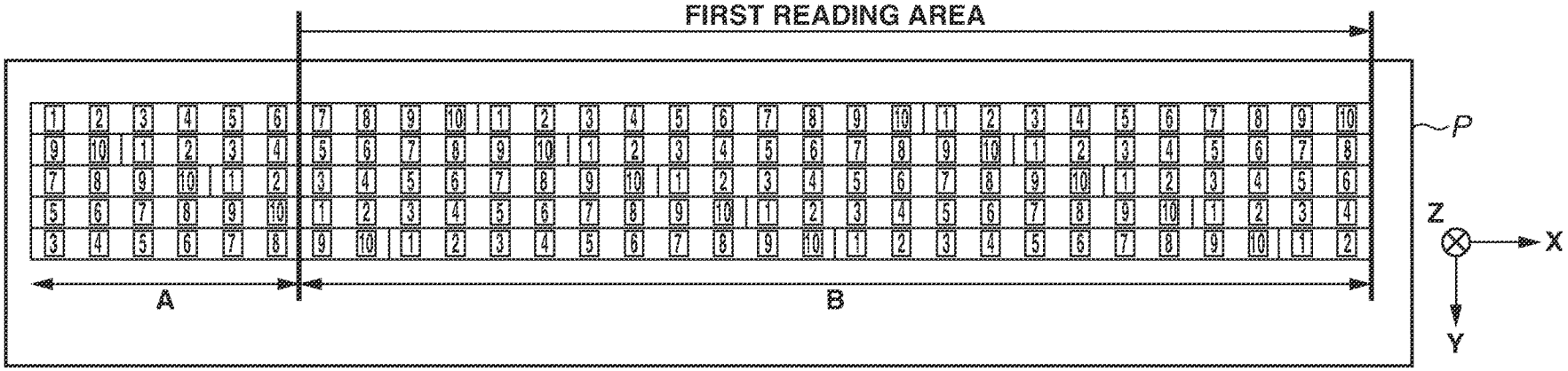
FIGS. 15A and 15B are schematic diagrams illustrating a reading area in each reading operation.
Figure 15B:
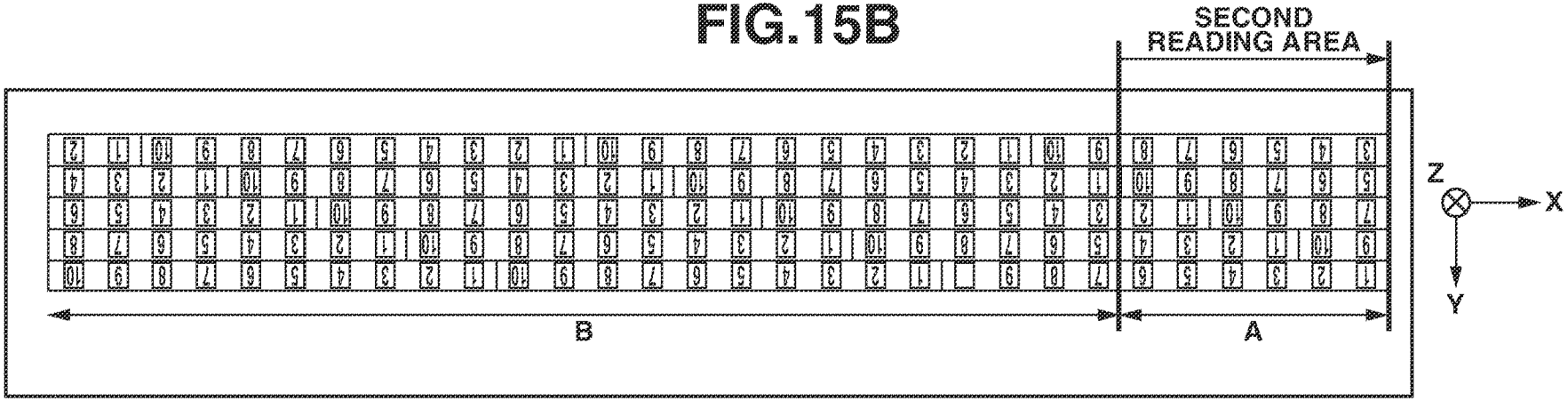

FIG. 14 is a flowchart illustrating registration adjustment value calculation processing according to the present exemplary embodiment. In step S1401, the test pattern is recorded on the entire area of the recording medium P in the scanning direction (X direction) of the carriage 102. An area readable in a single reading operation will be described with reference to FIGS. 15A and 15B. FIG. 15A illustrates an area (first reading area) to be read in a first reading operation in step S1402 (described below) and corresponds to the area B in FIG. 13B. FIG. 15B illustrates an area (second reading area) to be read in a second reading operation in step S406 (described below) and corresponds to the area A in FIG. 13B. The first reading area includes one end portion of the recording medium P, and the second reading area includes the other end portion of the recording medium P.

Returning to FIG. 14, in step S1402, the first reading operation is performed using the optical sensor 200. In this step, the patches included in the area B are read. The patches of all the five line patches in the area B are read. In step S1403, a reading result of the patches in the area B is stored as a first reading result. In step S404, the recording medium P is ejected. In step S1405, an operator is notified of information prompting the operator to turn the recording medium P upside down, reverse the leading edge and the trailing edge in the conveyance direction, and then place and re-feed the recording medium P. In the present exemplary embodiment, the notification is displayed on a display unit (not illustrated) of the main body of the recording apparatus 100. If the recording medium P is re-fed by the operator, the positions in the X direction (right-and-left direction in FIG. 15B) are reversed as illustrated in FIG. 15B. Accordingly, the positions of the area A and the area B in the X direction are reversed, and the patches in the area A that cannot be read in the first reading operation can be read. Then, in step S1406, the patches in the area A are read by the optical sensor 200 in the second reading operation. In step S1407, a reading result of the patches in the area A is stored and, in step S1408, the reading result of the patches in the area A and the reading result of the patches in the area B are combined. Since the positions in the right-and-left direction are reversed between the first reading result and the second reading result, it is necessary to perform processing for matching the positions between the first reading result and the second reading result. Accordingly, a reading result can be obtained from the entire area of the test pattern in the X direction. Finally, in step S1409, the registration adjustment value is calculated for each scanning position of the carriage 102 and, in step S1410, the calculated registration adjustment value is stored. In a case where an image is actually recorded on the recording medium P, image data is corrected based on the stored registration adjustment value for each scanning position of the carriage 102.

As described above, even if the entire area of the recording medium P in the scanning direction cannot be read in a single reading operation because, for example, the recording apparatus 100 is designed to have a narrower width, the registration adjustment value can be calculated in the entire area in the scanning direction by performing the reading operation in a plurality of separate times.

While the present exemplary embodiment has described the case where the first reading area and the second reading area are read in the first reading operation and the second reading operation, respectively, an area to be read is not limited to the above-described case. The entire area readable in a reading operation can be read, and areas of which reading results are to be used in combining reading results can be set to the above-described areas.

While the first exemplary embodiment has described the method of dividing the reading operation into two operations and reading patches in the entire scanning area of the carriage 102, in a second exemplary embodiment, a method will be described in which a first reading area and a second reading area are switched on a patch group basis.

Figure 16A:
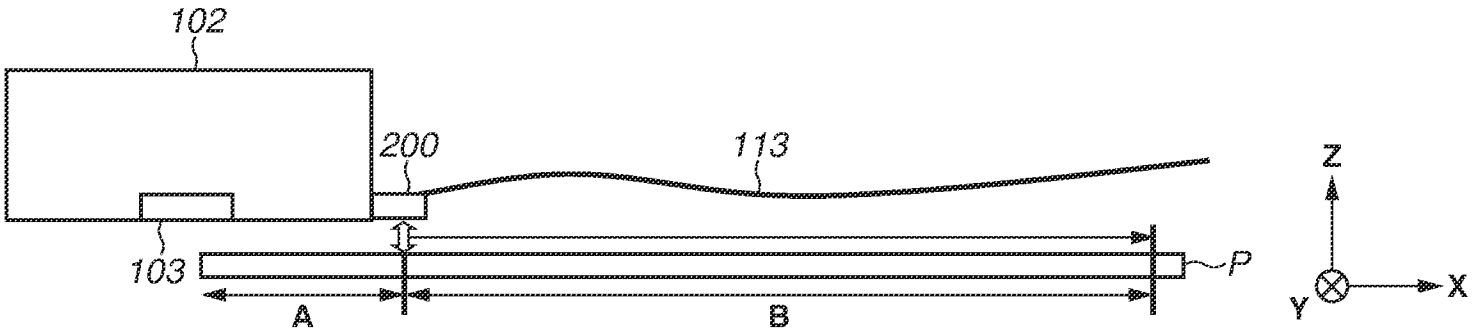
FIGS. 16A and 16B are schematic diagrams each illustrating a distance between the optical sensor and a recording medium.
Figure 16B:
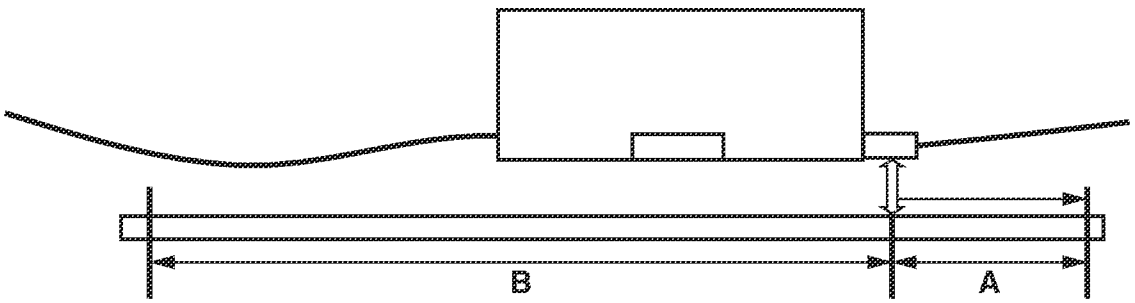

FIGS. 16A and 16B are schematic diagrams each illustrating a distance between the optical sensor 200 and the recording medium P. FIG. 16A illustrates a scanning position from which the first reading operation according to the first exemplary embodiment is started. FIG. 16B illustrates a scanning position from which the second reading operation according to the first exemplary embodiment is started. The carriage 102 has a different reading start position in the X direction for each of the first reading operation and the second reading operation. Thus, if the guide shaft 113 is curved, the posture of the carriage 102 varies and the distance between the optical sensor 200 and the recording medium P varies between the reading start position of the first reading operation and the reading start position of the second reading operation.

Figure 17:
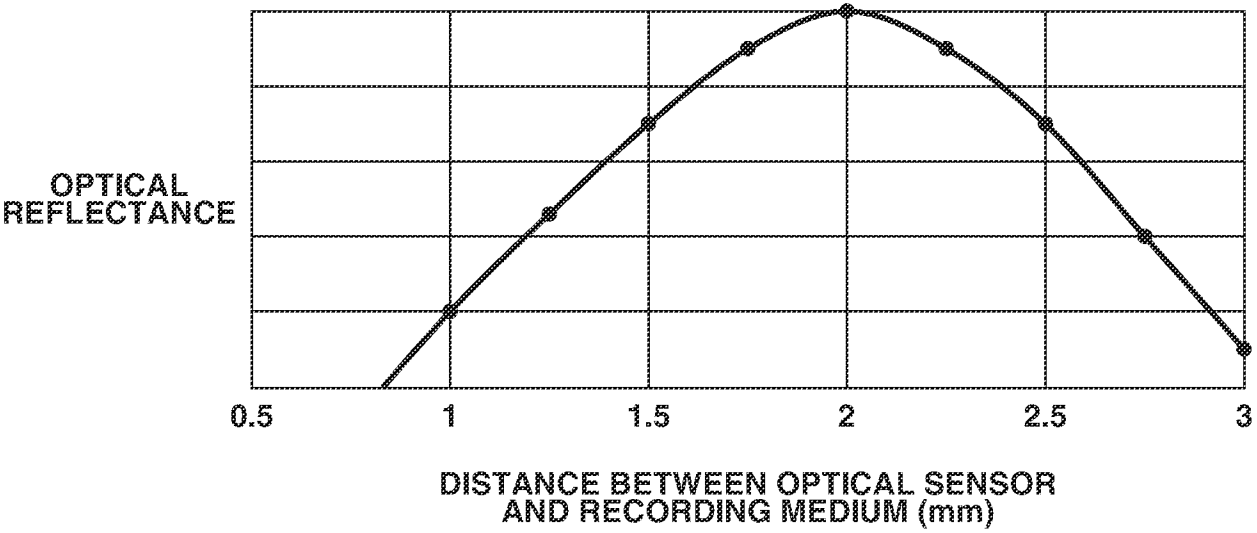
FIG. 17 is a graph illustrating a relationship between the distance between the optical sensor and the recording medium and optical reflectance.

FIG. 17 is a graph illustrating a relationship between the optical reflectance and the distance between the optical sensor 200 and the recording medium P. In the optical sensor 200, the light receiving unit 202 converts the reflected light 220 into an electrical signal. Thus, if the distance between the optical sensor 200 and the recording medium P changes, the reflected light 220 received by the light receiving unit 202 changes, and accordingly the optical reflectance changes. In FIG. 17, the optical reflectance peaks when the distance between the optical sensor 200 and the recording medium P is 2 mm, and then attenuates.

Figure 18A:
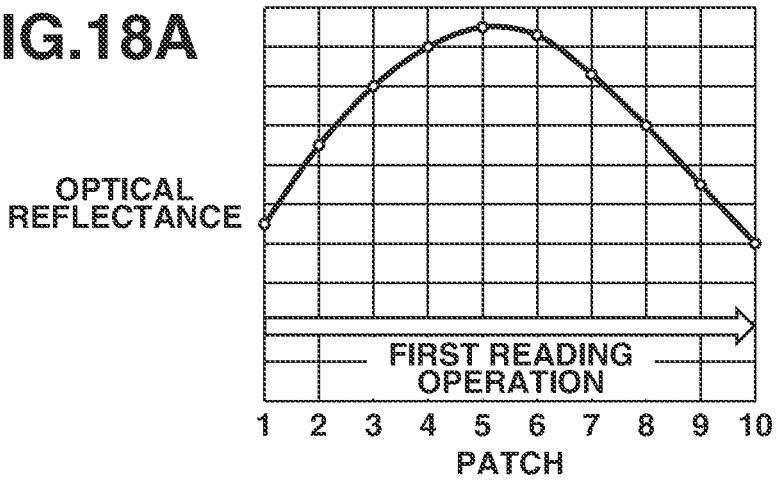
FIGS. 18A to 18C are graphs each illustrating optical reflectance of each reading area.
Figure 18B:
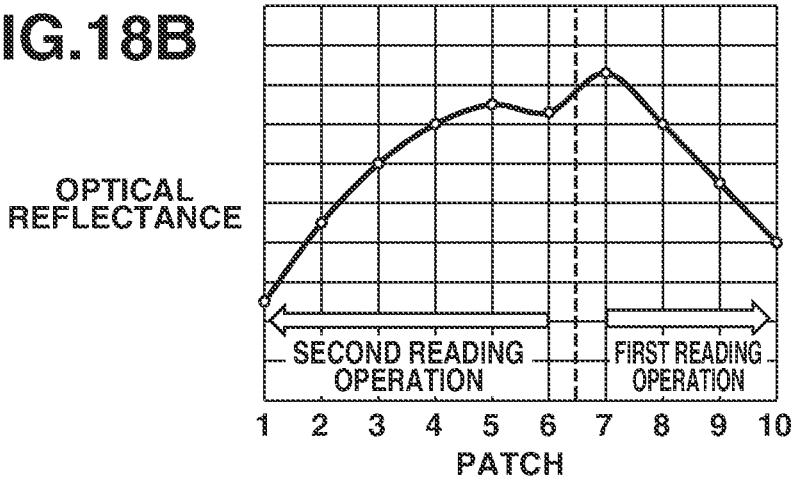
Figure 18C:
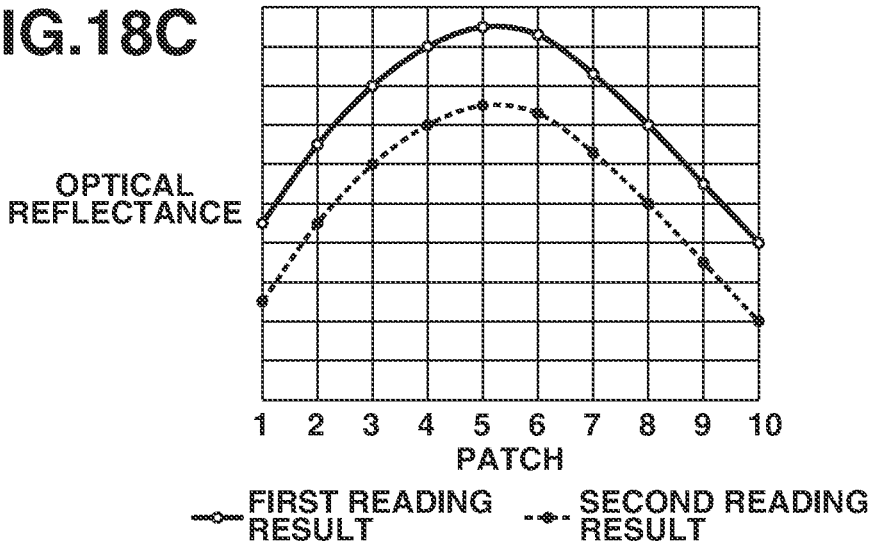

FIGS. 18A to 18C are graphs each illustrating relationships between patches and the optical reflectance in a case where the test pattern is divided into the first reading area and the second reading area. As described above, the patches 1 to 10 are arranged in each patch group. FIG. 18A is the graph illustrating the optical reflectance in a case where the patch group is read only in the first reading operation. The read value of each of the patches 1 to 10 is plotted, and the shift amount "a" of the patch 5 with which the optical reflectance is largest is set as the registration adjustment value. On the other hand, FIG. 18B is the graph illustrating the optical reflectance in a case where some patches in the patch group are read in the first reading operation and the others are read in second reading operation. More specifically, in FIG. 18B, the patches 1 to 6 and the patches 7 to 10 in the patch group are read in the second reading operation and the first reading operation, respectively. As described above, the distance between the optical sensor 200 and the recording medium P at the reading start position varies between the first reading operation and the second reading operation. Accordingly, the condition under which the patches 1 to 6 are read is different from the condition under which the patches 7 to 10 are read. Therefore, the transition of the optical reflectance of the patches 1 to 6 read in the second reading operation is different from the transition of the optical reflectance of the patches 7 to 10 read in the first reading operation. For example, if the distance between the recording medium P and the optical sensor 200 that reads the patches 7 to 10 in the first reading operation is closer to 2 mm than the distance in the second reading operation, the optical reflectance is higher as a whole in the first reading operation. Consequently, the shift amount "a" of the patch 7 with which the optical reflectance is largest is set as the registration adjustment value. In other words, if the reading operation for one patch group is divided into the first reading operation and the second reading operation, the registration adjustment values calculated from the respective reading operations deviate from each other. Therefore, it is desirable that the patches 1 to 10 included in one patch group are read in either the first reading operation or the second reading operation.

Figure 19A:
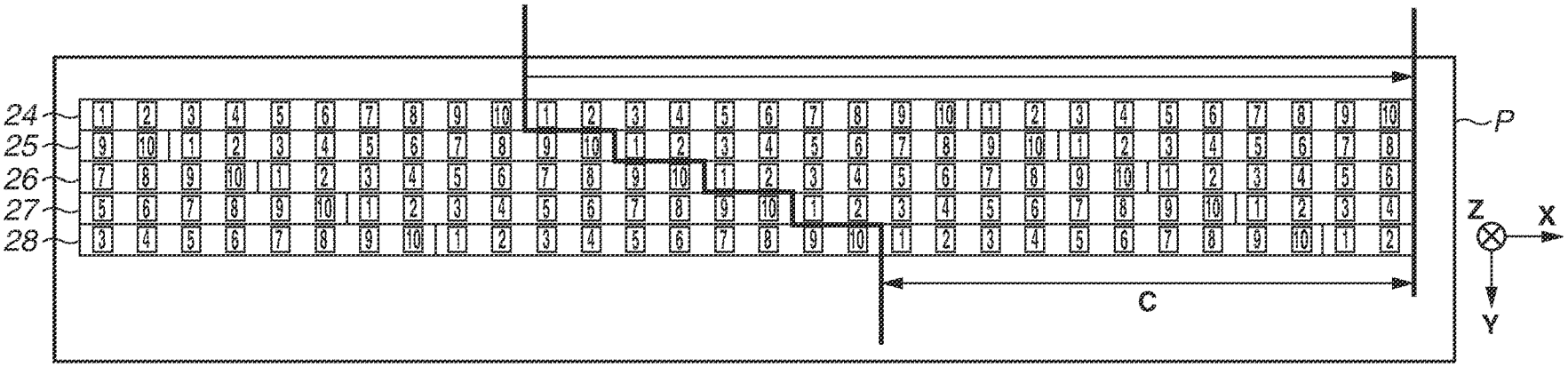
FIGS. 19A and 19B are schematic diagrams each illustrating a reading area in the test pattern.
Figure 19B:
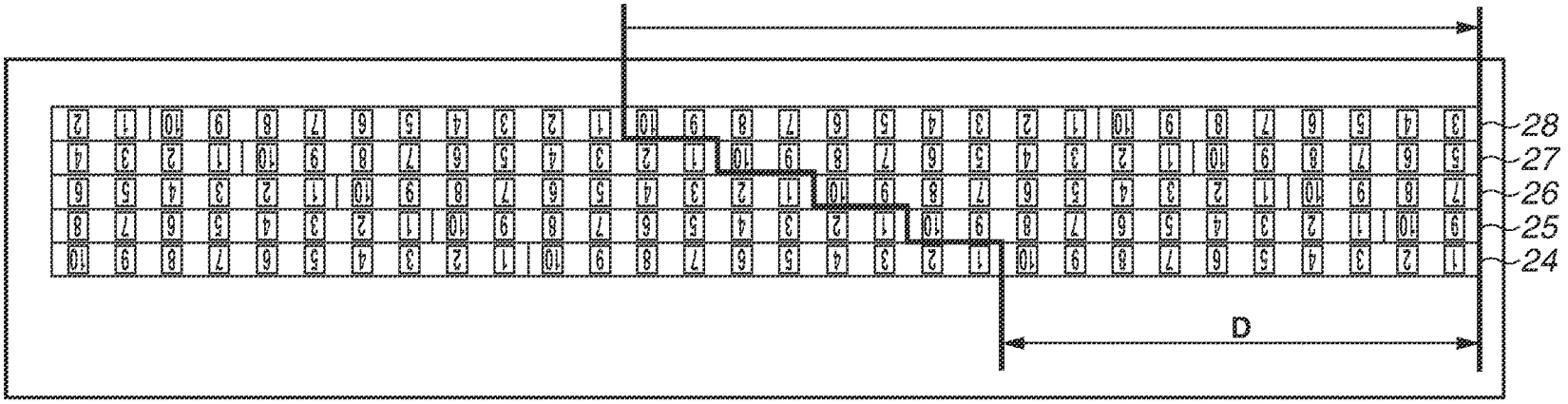

FIGS. 19A and 19B are schematic diagrams each illustrating a reading area in the test pattern according to the present exemplary embodiment. In the present exemplary embodiment, how to divide the test pattern into the area to be read in the first reading operation and the area to be read in the second reading operation is different from that in the first exemplary embodiment. An area C illustrated in FIG. 19A includes the patches to be read in the first reading operation, and an area D illustrated in FIG. 19B includes the patches to be read in the second reading operation. The area C includes patches from the 11th patch from the left end to the patch at the right end in the line patch 24, patches from the 13th patch from the left end to the patch at the right end in the line patch 25, patches from the 15th patch from the left end to the patch at the right end in the line patch 26, patches from the 17th patch from the left end to the patch at the right end in the line patch 27, and patches from the 19th patch from the left end to the patch at the right end in the line patch 28. On the other hand, the area D indicates the patches to be read in the second reading operation, and includes patches from the 18th patch from the right end to the patch at the right end in the line patch 28 which is the first row, patches from the 16th patch from the right end to the patch at the right end in the line patch 27 which is the second row, patches from the 14th patch from the right end to the patch at the right end in the line patch 26 which is the third row, patches from the 12th patch from the right end to the patch at the right end in the line patch 25 which is the fourth row, and patches from the 10th patch from the right end to the patch at the right end in the line patch 24 which is the fifth row.

Similarly to the first exemplary embodiment, the reading operation is divided into two operations, one for the area C and the other for the area D, to obtain optical measurement results in the entire scanning area of the carriage 102. At this time, one patch group is read in the same reading operation, so that a variation in the transition of the optical reflectance within the patch group can be prevented. In addition, since the registration adjustment value is calculated from the peak in the transition of the optical reflectance, even if the distance between the optical sensor 200 and the recording medium P changes as illustrated in FIG. 17 and the optical reflectance is increased or decreased as a whole, the variation in the transition of the optical reflectance is low. Therefore, an influence on the registration adjustment value can be suppressed.

As described above, the patches in each patch group are read in either the first reading operation or the second reading operation, so that the variation in the transition of the optical reflectance within the patch group can be suppressed, correction can be performed based on an appropriate registration adjustment value, and highly accurate output can be obtained. Similarly to the above-described exemplary embodiment, areas to be actually read may be larger than the areas illustrated in FIGS. 19A and 19B, and areas of which reading results are to be used may be set to the above-described areas. For example, in a case where the entire area in the scanning direction can be read in each reading operation, but reading accuracy cannot be maintained in the entire area due to a mechanical configuration and the like, it is possible to use only the reading results of the above-described areas after reading the entire area.

While the above-described second exemplary embodiment has described the case where only one of the reading results from the first reading operation and the second reading operation is used for one patch group. In a third exemplary embodiment, a determination method about the second reading operation is added.

In the above-described exemplary embodiments, since the recording medium P needs to be re-fed before the second reading operation, there is a possibility that a conveyance deviation may occur due to skew of the recording medium P and the like. The conveyance deviation of the recording medium P causes a reading position deviation in the second reading operation, resulting in failure to read patches with high accuracy. Thus, there is a method for suppressing the reading position deviation by correcting the skew of the recording medium P before feeding and correcting the position of the re-fed recording medium P in the X direction and the Y direction. However, there is a possibility that the recording medium P cannot be read correctly in the second reading operation due to a fault in the position correction processing, dirt on a patch, or the like.

Figure 20:
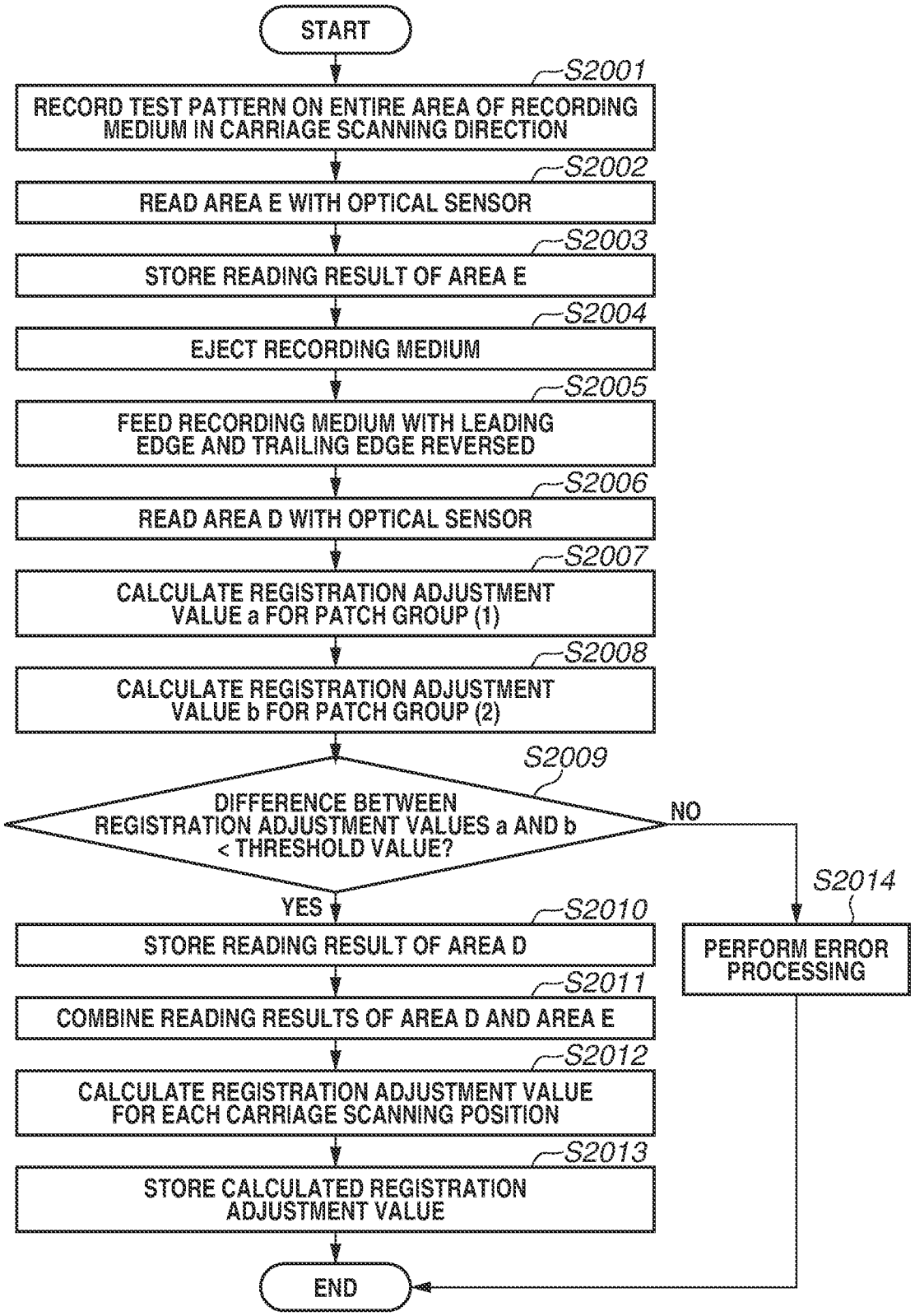
FIG. 20 is a flowchart illustrating an example of registration adjustment value calculation.

FIG. 20 is a flowchart illustrating an example of registration adjustment value calculation according to the present exemplary embodiment. Similarly to the first and the second exemplary embodiments, in steps S2001 to S2006, the test pattern is recorded on the entire area of the recording medium P in the scanning direction of the carriage 102, and a reading operation is performed twice.

Figure 21A:
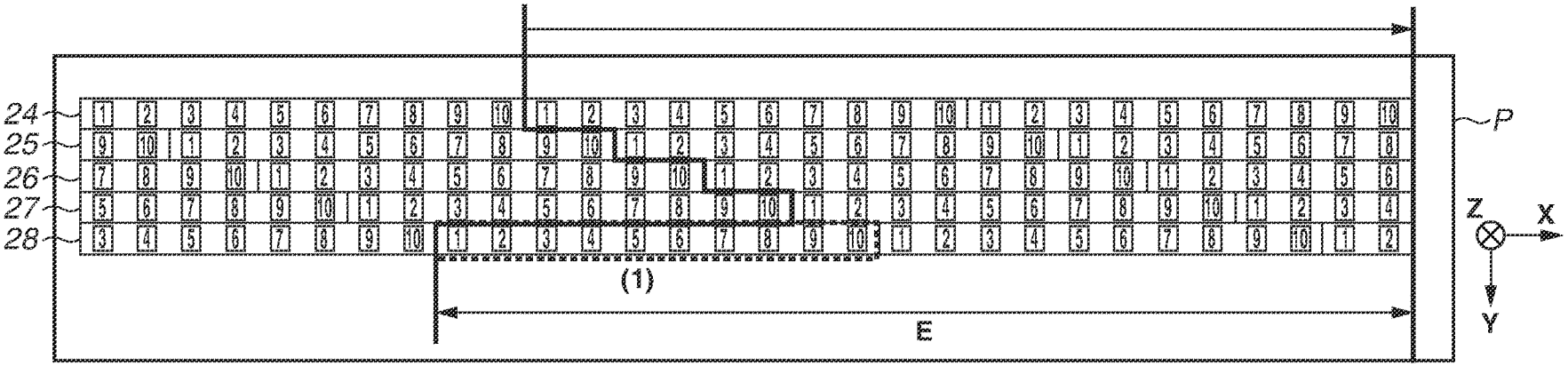
FIGS. 21A and 21B are schematic diagrams each illustrating a reading area and a patch group in the test pattern.
Figure 21B:
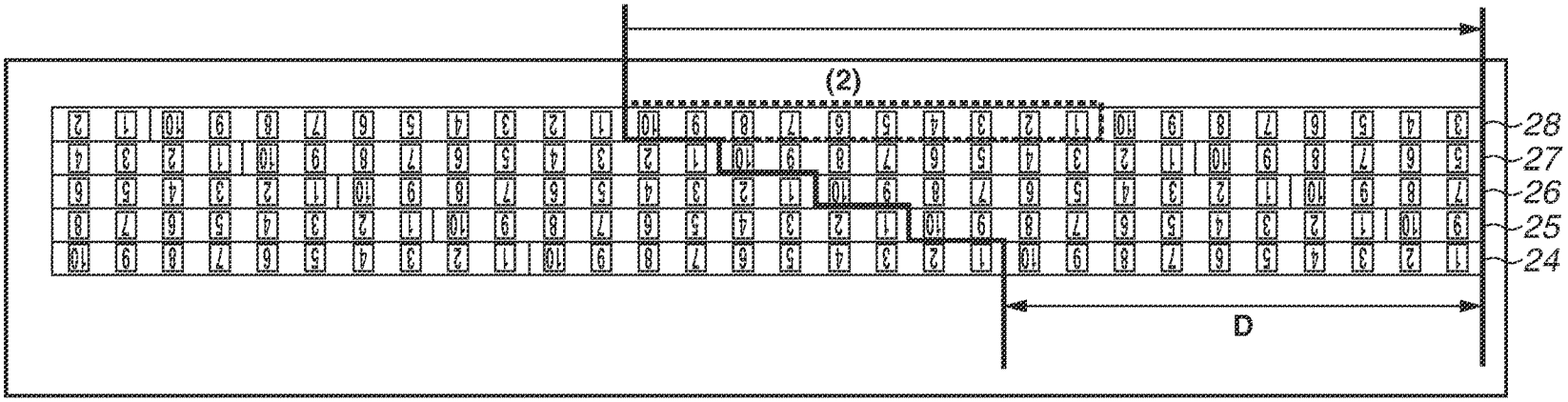

FIGS. 21A and 21B are schematic diagrams each illustrating a reading area in the test pattern and a patch group used for determination in the second reading operation according to the present exemplary embodiment. An area E illustrated in FIG. 21A includes the patches to be read in the first reading operation, and an area D illustrated in FIG. 21B includes the patches to be read in the second reading operation. The area D is same as the area D according to the second exemplary embodiment. In the area E, the line patches 24 to 27 are same as those in the area C according to the second exemplary embodiment, but in the line patch 28, patches from the 9th patch from the left end to the patch at the right end are included. A patch group (1) in FIG. 21A and a patch group (2) in FIG. 21B are the same. In the present exemplary embodiment, the same patch group is read in the first reading operation and the second reading operation.

Returning to FIG. 20, in step S2007, a registration adjustment value "a" is calculated based on a reading result of the patch group (1) in FIG. 21A in the first reading operation. Next, in step S2008, a registration adjustment value "b" is calculated based on a reading result of the patch group (2) in FIG. 21B in the second reading operation.

Figure 22A:
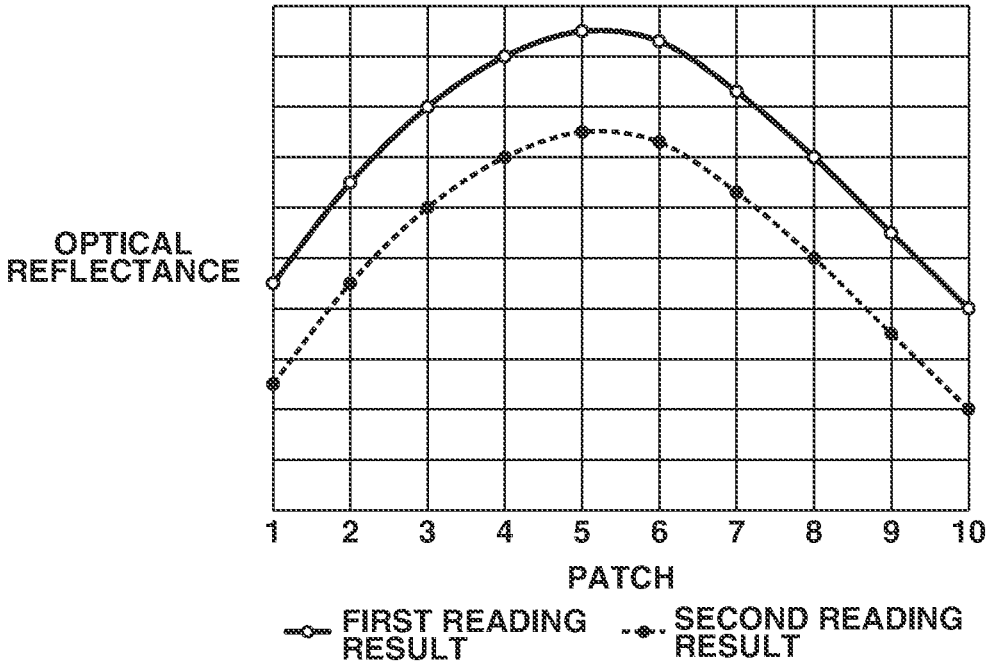
FIGS. 22A and 22B are graphs each illustrating optical reflectance of the patch group.
Figure 22B:
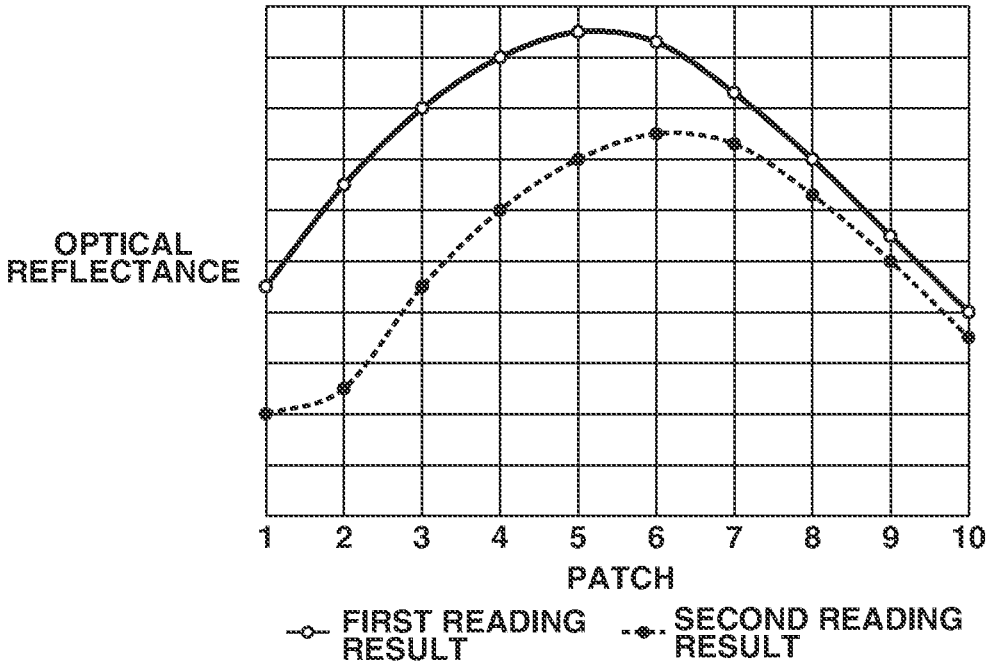

FIGS. 22A and 22B are graphs each illustrating optical reflectance of the patch group according to the present exemplary embodiment. FIG. 22A is the graph illustrating the optical reflectance of the patch group in a case where the patches are correctly read. The distance between the optical sensor 200 and the recording medium P at the reading start position varies between the first reading operation and the second reading operation, and a reading error is added. Accordingly, a difference corresponding to the reading error occurs between the first reading result and the second reading result as a whole. However, the variation in the transition of the optical reflectance is low between the first reading operation and the second reading operation, and a difference between the registration adjustment values calculated from the respective reading operations is small. FIG. 22B is the graph illustrating the optical reflectance in a case where the reading position is deviated by one patch in the X direction. A variation corresponding to the reading position deviation occurs in the transition of the optical reflectance. Consequently, the corresponding variation occurs in the calculated registration adjustment value. In the present exemplary embodiment, the same patch group is read in the first reading operation and the second reading operation, and the registration adjustment value based on the first reading operation and the registration adjustment value based on the second reading operation are compared with each other, so that whether the reading position is correct can be determined. In the present exemplary embodiment, the deviation in the X direction has been described. However, whether the reading position is correct can also be determined in a case where there is a deviation in the Y direction or dirt on a patch, which also causes a variation in the transition of the optical reflectance.

In step S2009, it is determined whether a difference between the registration adjustment value "a" based on the first reading operation and the registration adjustment value "b" based on the second reading operation for the same patch group is less than a threshold value of 20 μm, and it is determined whether the reading of the patch group in the second reading operation is correct. In the present exemplary embodiment, the threshold value is set to 20 μm. However, there is a possibility that a measurement error may be included in a case where the optical reflectance is measured by the optical sensor 200, and thus a threshold value "c" is set. In a case where the difference between the registration adjustment value "a" based on the first reading operation and the registration adjustment value "b" based on the second reading operation for the same patch group is less than the threshold value "c" (YES in step S2009), it is determined that the reading result from the second reading operation is correct, and, in step S2010, the reading result from the second reading operation is stored. Then, in step S2011, the reading results from the first reading operation and the second reading operation are combined. At this time, either of the reading results from the first reading operation and the second reading operation can be used for the patch group. However, it is desirable to prioritize the reading result from the first reading operation since an error in the reading position is smaller in the first reading operation. Similarly to the first and the second exemplary embodiments, in step S2012, the registration adjustment value is calculated for each scanning position of the carriage 102, and, in step S2013, the calculated registration adjustment value is stored.

On the other hand, in step S2009, in a case where the difference between the registration adjustment value "a" based on the first reading operation and the registration adjustment value "b" based on the second reading operation for the same patch group is the threshold value "c" or more (NO in step S2009), it is determined that the reading is not performed correctly, and, in step S2014, error processing is performed and then the processing ends. The error processing according to the present exemplary embodiment is to notify the operator of the error and to terminate the adjustment without calculating the registration adjustment value.

As described above, a predetermined patch group is read in the first reading operation and the second reading operation, and it is determined that the reading position of the patch group in the second reading operation is correct based on the difference between the calculated registration adjustment values. Accordingly, an erroneous reading result can be excluded, and the registration adjustment value can be calculated appropriately.

According to the above-described exemplary embodiments, the reading operation is performed using the optical sensor 200 a plurality of times, so that the test pattern can be read in the entire area in the scanning direction and the recording position deviation can be corrected.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2019-229267, filed Dec. 19, 2019, which is hereby incorporated by reference herein in its entirety.

What is claimed is:

1. A recording apparatus comprising:

a carriage configured to mount a recording unit and a reading unit thereon and to scan in a scanning direction, the recording unit including an ejection port array in which a plurality of ejection ports for ejection of ink on a recording medium is arranged;

a conveyance member configured to convey the recording medium in a conveyance direction intersecting with the scanning direction;

a notification unit configured to notify information;

a control unit configured to control, using the recording unit, a recording operation for recording a test pattern including patches in order to control the ejection of the ink at each position in the scanning direction, and to control, using the reading unit, a reading operation for reading the test pattern recorded on the recording medium while causing the carriage to scan; and a determination unit configured to determine an adjustment value for controlling the ejection of the ink at the each position in the scanning direction, based on a result of the reading in the reading operation, wherein the control unit executes a first reading operation for reading the test pattern on the recording medium, and wherein, after the first reading operation, the notification unit notifies the information which prompts feeding of the recording medium in a state where a leading edge of the recording medium and a trailing edge of the recording medium in the first reading operation in the conveyance direction are reversed, wherein the control unit executes a second reading operation for reading the test pattern on the recording medium fed according to the information notified by the notification unit, and wherein the determination unit determines the adjustment value for controlling the ejection of the ink at the each position in the scanning direction, based on a first reading result from the first reading operation and a second reading result from the second reading operation.

2. The recording apparatus according to claim 1, wherein the determination unit determines the adjustment value for controlling the ejection of the ink at the each position in the scanning direction, based on a result, among a plurality of results included in the first reading result, corresponding to a first reading area including one end portion in the scanning direction of the recording medium on which the test pattern is recorded, and a result, among a plurality of results included in the second reading result, corresponding to a second reading area including another end portion in the scanning direction of the recording medium on which the test pattern is recorded.

3. The recording apparatus according to claim 2, wherein in the first reading operation, the first reading area is read and at least a part of the second reading area is not read, and in the second reading operation, the second reading area is read and at least a part of the first reading area is not read.

4. The recording apparatus according to claim 1, wherein after executing the first reading operation, the control unit ejects the recording medium on which the test pattern is recorded, and causes a display unit to display the information for prompting an operator to feed the recording medium in the state where the leading edge and the trailing edge are reversed with respect to the conveyance direction in the first reading operation.

5. The recording apparatus according to claim 1, wherein in the test pattern, a patch group including a plurality of patches is recorded at the each position in the scanning direction, and wherein each of the patches includes a first pattern and a second pattern recorded at a timing different from a timing at which the first pattern is recorded.

6. The recording apparatus according to claim 5, wherein in the test pattern, a first patch group including a first patch and a second patch group including a second patch are recorded at different positions in the conveyance direction, the first patch and the second patch corresponding to a same position in the scanning direction, and wherein a difference between the timing at which the first pattern is recorded and the timing at which the second pattern is recorded is a difference between the first patch and the second patch.

7. The recording apparatus according to claim 5, wherein the recording unit includes a first ejection port array and a second ejection port array, wherein the first pattern and the second pattern are recorded using the first ejection port array and the second ejection port array, respectively, in a single scanning of the carriage, and wherein the adjustment value determined by the determination unit is an adjustment value for setting an ejection timing from the first ejection port array and an ejection timing from the second ejection port array in a same scanning as the single scanning.

8. The recording apparatus according to claim 7, wherein the first ejection port array and the second ejection port array are disposed on a first chip and a second chip, respectively, in the recording unit.

9. The recording apparatus according to claim 5, wherein the first pattern is recorded using the ejection port array in a forward direction scanning of the carriage, and the second pattern is recorded using the ejection port array in a reverse direction scanning of the carriage, wherein the adjustment value determined by the determination unit is an adjustment value for setting an ejection timing from the ejection port array in the forward direction scanning of the carriage and an ejection timing from the ejection port array in the reverse direction scanning of the carriage.

10. The recording apparatus according to claim 1, wherein the recording unit and the reading unit are arranged on the carriage at positions separated from each other in the scanning direction.

11. The recording apparatus according to claim 1, wherein the recording unit is capable of recording an image on an entire area in the scanning direction of the recording medium having a maximum width in the scanning direction, and the reading unit is capable of reading only a part of the recording medium in the scanning direction.

12. The recording apparatus according to claim 1, wherein the test pattern includes the patches recorded on an entire area of the recording medium in the scanning direction.

13. The recording apparatus according to claim 1, wherein the determination unit performs processing for matching a direction of an image of the first reading result with a direction of an image of the second reading result.

14. A method for controlling a recording apparatus that includes a carriage configured to mount a recording unit and a reading unit thereon and to scan in a scanning direction, the recording unit including an ejection port array in which a plurality of ejection ports for ejection of ink on a recording medium is arranged, and a conveyance member configured to convey the recording medium in a conveyance direction intersecting with the scanning direction, the method comprising:

controlling, using the recording unit, a recording operation for recording a test pattern including patches in order to control the ejection of the ink at each position in the scanning direction;

controlling, using the reading unit, a first reading operation for reading the test pattern recorded on the recording medium while causing the carriage to scan;

notifying, by the notification unit, after the first reading operation, the information which prompts feeding of the recording medium in a state where a leading edge of the recording medium and a trailing edge of the recording medium in the first reading operation in the conveyance direction are reversed;

controlling, using the reading unit, a second reading operation for reading the test pattern recorded on the recording medium fed according to the information notified by the notification unit; and determining an adjustment value for controlling the ejection of the ink at the each position in the scanning direction, based on a first reading result of the reading in the first reading operation and a second reading result of the reading in the second reading operation.

15. A non-transitory computer-readable storage medium storing a program for causing a computer to execute a method for controlling a recording apparatus that includes a carriage configured to mount a recording unit and a reading unit thereon and to scan in a scanning direction, the recording unit including an ejection port array in which a plurality of ejection ports for ejection of ink on a recording medium is arranged, and a conveyance member configured to convey the recording medium in a conveyance direction intersecting with the scanning direction, the method comprising:

controlling, using the recording unit, a recording operation for recording a test pattern including patches in order to control the ejection of the ink at each position in the scanning direction;

controlling, using the reading unit, a first reading operation for reading the test pattern recorded on the recording medium while causing the carriage to scan; and notifying, by the notification unit, after the first reading operation, the information which prompts feeding of the recording medium in a state where a leading edge of the recording medium and a trailing edge of the recording medium in the first reading operation in the conveyance direction are reversed;

controlling, using the reading unit, a second reading operation for reading the test pattern recorded on the recording medium fed according to the information notified by the notification unit; and determining an adjustment value for controlling the ejection of the ink at the each position in the scanning direction, based on a first reading result of the reading in the first reading operation and a second reading result of the reading in the second reading operation.

16. A recording apparatus comprising:

a carriage configured to mount a recording unit and a reading unit thereon and to scan in a scanning direction, the recording unit including an ejection port array in which a plurality of ejection ports for ejection of ink on a recording medium is arranged;

a conveyance member configured to convey the recording medium in a conveyance direction intersecting with the scanning direction;

a control unit configured to control, using the recording unit, a recording operation for recording a test pattern including patches in order to control the ejection of the ink at each position in the scanning direction, and to control, using the reading unit, a first reading operation for reading the test pattern recorded on the recording medium while causing the carriage to scan and a second reading operation for reading the test pattern recorded on the recording medium while causing the carriage to scan; and a determination unit configured to determine an adjustment value for controlling the ejection of the ink at the each position in the scanning direction, based on a first result of the reading in the first reading operation and a second result of the reading in the second reading operation, wherein the determination unit performs processing for matching a direction of an image of the first reading result with a direction of an image of the second reading result, and determines the adjustment value based on a result of the processing.

17. A method for controlling a recording apparatus that includes a carriage configured to mount a recording unit and a reading unit thereon and to scan in a scanning direction, the recording unit including an ejection port array in which a plurality of ejection ports for ejection of ink on a recording medium is arranged, and a conveyance member configured to convey the recording medium in a conveyance direction intersecting with the scanning direction; the method comprising:

controlling, using the recording unit, a recording operation for recording a test pattern including patches in order to control the ejection of the ink at each position in the scanning direction, and to control, using the reading unit, a first reading operation for reading the test pattern recorded on the recording medium while causing the carriage to scan and a second reading operation for reading the test pattern recorded on the recording medium while causing the carriage to scan; and determining an adjustment value for controlling the ejection of the ink at the each position in the scanning direction, based on a first result of the reading in the first reading operation and a second result of the reading in the second reading operation, wherein in the determining, processing for matching a direction of an image of the first reading result with a direction of an image of the second reading result is performed, and the adjustment value is determined based on a result of the processing.

* * * * *